US007654396B2

(12) United States Patent
Takeno et al.

(10) Patent No.: US 7,654,396 B2
(45) Date of Patent: Feb. 2, 2010

(54) CLASSIFIER, VERTICAL CRUSHER HAVING THE CLASSIFIER, AND COAL FIRED BOILER APPARATUS HAVING THE VERTICAL CRUSHER

(75) Inventors: Yutaka Takeno, Kure (JP); Hiroaki Kanemoto, Kure (JP); Teruaki Tatsuma, Kure (JP); Takashi Harada, Kure (JP); Taketoshi Tanabe, Kure (JP)

(73) Assignee: Babcock-Hitachi Kabushiki Kaisha, Tokyo (JP)

( * ) Notice: Subject to any disclaimer, the term of this patent is extended or adjusted under 35 U.S.C. 154(b) by 480 days.

(21) Appl. No.: 11/596,463

(22) PCT Filed: May 12, 2005

(86) PCT No.: PCT/JP2005/008684

§ 371 (c)(1),
(2), (4) Date: Nov. 13, 2006

(87) PCT Pub. No.: WO2005/110629

PCT Pub. Date: Nov. 24, 2005

(65) Prior Publication Data

US 2007/0228194 A1 Oct. 4, 2007

(30) Foreign Application Priority Data

May 13, 2004 (JP) ..... 2004-143571

(51) Int. Cl.

| | |
|---|---|
| ***B02C 23/08*** | (2006.01) |
| ***B02C 13/00*** | (2006.01) |
| ***B02C 17/02*** | (2006.01) |
| ***B07B 7/04*** | (2006.01) |
| ***B04B 5/12*** | (2006.01) |

(52) U.S. Cl. ..... 209/713; 209/143; 241/79.3; 241/80

(58) Field of Classification Search ..... 209/138, 209/139.1, 142, 143, 710, 713, 714, 718; 241/79, 79.1, 79.3, 80, 19

See application file for complete search history.

(56) References Cited

U.S. PATENT DOCUMENTS

| | | | | |
|---|---|---|---|---|
| 4,504,018 | A * | 3/1985 | Diggins | 241/53 |
| 5,667,149 | A * | 9/1997 | Eisinger | 241/18 |
| 5,957,300 | A * | 9/1999 | Nardi et al. | 209/143 |

FOREIGN PATENT DOCUMENTS

| | | |
|---|---|---|
| JP | 10-109045 | 4/1998 |

(Continued)

OTHER PUBLICATIONS

K.D. Tigges et al., Ring and Roller Bowl Mill as Components of Modern Firing Technology, VGB Power Tech, vol. 11, pp. 34-43 (1998).

*Primary Examiner*—Patrick H Mackey
*Assistant Examiner*—Mark Hageman
(74) *Attorney, Agent, or Firm*—Antonelli, Terry, Stout & Kraus, LLP.

(57) ABSTRACT

A classifier capable of stably providing particles by further reducing the mixing ratio of coarse particles including a rotating fin (21) classifying solid particles by a centrifugal force, a cylindrical downward flow forming member (13) installed on the outer peripheral side of the rotating fin (21), a recovery cone (11) disposed under the rotating fin (21) and the downward flow forming member (13), and a housing (41). A contraction flow area (16) is formed between the housing (41) and the recovery cone (11), and a two-phase flow (52) formed of the mixture of the solid particles and gases blown up through the contraction flow area (16) is collided with the downward flow forming member (13) on the upper side of the housing (41) to form it in a downward flow. Then, that flow is led to the rotating fin side, classified into the fine particles and the coarse particles, and the fine particles are carried together with an airstream, passed through the rotating fin (21), and removed. A circulating swirl flow development suppressing part (30) is installed at the upper part of the contraction flow area (16) and on the outer periphery of the downward flow forming member (13).

11 Claims, 19 Drawing Sheets

FOREIGN PATENT DOCUMENTS

| | | |
|---|---|---|
| JP | 2000-051723 | 2/2000 |
| JP | 2002-018300 | 1/2002 |
| JP | 2002-018360 | 1/2002 |
| JP | 2002-233825 | 8/2002 |

* cited by examiner

CLASSIFIER, VERTICAL CRUSHER HAVING THE CLASSIFIER, AND COAL FIRED BOILER APPARATUS HAVING THE VERTICAL CRUSHER

TECHNICAL FIELD

The present invention relates to a classifier for separating coarse particle and fine particles from a group of solid particles carried by a gas, and particularly to a classifier which is preferable for being incorporated in a vertical crusher of a coal fired boiler apparatus.

BACKGROUND ART

In a coal fired boiler apparatus for a thermal power generation burning a pulverized coal as a fuel, a vertical crusher is used in a fuel supply apparatus.

FIG. 21 is a view of an outline structure of a conventional vertical crusher, FIG. 22 is a view of a partial outline structure of a classifier provided in the vertical crusher, and FIG. 23 is a cross sectional view on a line X-X in FIG. 22. The vertical crusher is mainly constituted by a crushing portion 5 crushing a coal 50 corresponding to a raw material of a pulverized coal on the basis of an engagement between a crushing table 2 and a crushing ball 3 (or a crushing roller), and a classifier 6 installed in an upper portion of the crushing portion 5 and classifying the pulverized coal to an optional grain size.

Next, a description will be given of an operation of the vertical crusher. The coal 50 corresponding to a crushed material supplied from a coal supply tube 1 comes down to a center portion of the rotating crushing table 2 as shown by an arrow, thereafter moves to an outer peripheral portion while drawing a spiral locus on the crushing table 2 on the basis of a centrifugal force generated together with the rotation of the crushing table 2, and is engaged between the crushing table 2 and the crushing ball 3 so as to be crushed.

The crushed particles are blown up to an upper side while being dried by a hot wind introduced from a throat 4 provided in the periphery of the crushing table 2. The particles having a large grain size in the blown-up particles come down due to a gravity in the middle of being carried to the classifier 6, and are returned to the crushing portion 5 (a primary classification).

The group of particles reaching the classifier 6 are classified into the fine particles having a grain size equal to or smaller than a predetermined grain size, and the coarse particles having a grain size larger than the predetermined grain size (a secondary classification), and the coarse particles come down to the crushing portion 5 so as to be crushed again. On the other hand, the fine particles getting out of the classifier 6 are fed to a coal fired boiler apparatus (not shown) from a discharge pipe 7.

The classifier 6 is formed as a two-stage structure comprising a fixed type classifying mechanism 10 and a rotary type classifying mechanism 20. The fixed type classifying mechanism 10 has a fixed fin 12 and a recovery cone 11. The fixed fin 12 is suspended downward from a ceiling wall 40 as shown in FIGS. 21 and 22, and a lot of fixed fins 12 are fixed at an optional angle with respect to a direction of a center axis of the classifier 6 as shown in FIG. 23. The recovery cone 11 is provided in a bowl shape in a lower side of the fixed fin 12.

The rotary type classifying mechanism 20 has a rotating shaft 22, a rotating fin 21 supported to the rotating shaft 22, and a motor 24 rotationally driving the rotating shaft 22. The rotating fin 21 is structured such that a longitudinal direction of a plate extends approximately in parallel to a direction of a center axis (a direction of the rotating axis) of the classifier 6, and a lot of rotating fins 21 are arranged at an optional angle with respect to the direction of the center axis of the classifier 6 as shown in FIG. 23, and rotate in a direction of an arrow 23.

As shown in FIG. 22, a solid and gas two-phase flow 52 constituted by a mixture of solid particles and gas blown up from a downward side so as to be introduced to the classifier 6 is first rectified at a time of passing through the fixed fins 12 and a weak swing motion is previously applied at the same time (refer to FIG. 23). Further, a strong swing motion is applied at a time of reaching the rotating fins 21 rotating at a predetermined rotating speed around the rotating shaft 22, and a force flipping the particles to an outer side of the rotating fins 21 is applied to the particles in the solid and gas two-phase flow 52 on the basis of a centrifugal force. Since the great centrifugal force is applied to the coarse particles 53 having a great mass, the coarse particles 53 are separated from the air flow passing through the rotating fin 21. Further, the coarse particles come down from a portion between the rotating fins 21 and the fixed fins 12 as shown in FIG. 22, and finally slide on an inner wall of the recovery cone 11 so as to come down to the crushing portion 5.

On the other hand, the fine particles 54 pass through the portion between the rotating fins 21 rotating together with the air flow due to its small centrifugal force, and are discharged as product fine powders to an outer portion of the vertical crusher. A grain size distribution of the product fine powders can be adjusted by a rotating speed of the rotary type classifying mechanism 20. In this case, reference numeral 41 denotes a housing of the crushing portion 5.

In the product pulverized coal supplied to the coal fired boiler apparatus, a pulverized coal in which a grain size distribution is sharp and the coarse particles are hardly mixed is required, for reducing air pollutants such as nitrogen oxide (NOx) or the like and a cinder unburned combustible. Specifically, it aims at making a mixed rate of the coarse particles of 100 mesh over equal to or less than 1 weight % in the case that a mass rate of the fine particles of 200 mesh pass (a grain diameter equal to or smaller than 75 μm) is 70 to 80 weight %.

The following patent document 1 describes a classifier which can reduce the mixing rate of the coarse particles of 100 mesh over in comparison with the conventional classifier. FIG. 24 is a view of a partial outline structure of the classifier.

The classifier is provided with a cylindrical downward flow forming member 13 suspended from an upper surface plate 40 in an outer peripheral side of the rotating fins 21. The solid and gas two-phase flow 52 coming up from the crushing portion ascends to the below of the upper surface plate 40 on the basis of an inertia force. Further, the flow comes to a downward flow moving downward on the basis of the gravity after passing through a gap of the fixed fins 12 and coming into collision with the downward flow forming member 13. When the flow changes to the flow toward the rotating fins 21 side near a lower end portion of the downward flow forming member 13, the coarse particles 53 having the great gravity and the great downward inertia force are separated from the flow, and come down to the lower portion along the inner wall of the recovery cone 11. Accordingly, the group of particles hardly including the coarse particles 53 reach the rotating fins 21, and it is possible to reduced the mixing rate of the coarse particles in the product fine particles.

The following patent document 2 describes defining proper length and position of the downward flow forming member 13.

Patent Document 1: JP-A-10-109045

Patent Document 1: JP-A-2000-51723

DISCLOSURE OF THE INVENTION

Problem to be Solved by the Invention

FIG. 25 is a view showing a gas flow pattern in accordance with a flow numerical analysis within the classifier shown in FIG. 24. As is apparent from this drawing, a great circulating swirl flow 14 is generated in a region Y between the downward flow forming member 13 and the housing 41.

An ideal gas flow for efficiently removing the coarse particles 53 by the downward flow forming member 13 corresponds to a flow extending along the downward flow forming member 13 from the upper surface plate 40, however, the gas flows at a position downward away from the upper surface plate 40, due to the existence of the circulating swirl flow 14.

FIG. 26 is a view showing a flow state of the group of particles from the recovery cone 11 to the downward flow forming member 13. The group of particles coming up from the recovery cone 11 are pressed and bent approximately in a horizontal direction before reaching the portion near the upper surface plate 40 on the basis of an interference with the circulating swirl flow 14, and it is known that the separating effect of the coarse particles by the downward flow forming member 13 is effectively achieved only by coming into collision with the lower end portion of the downward flow forming member 13.

A description will be given of a generating and developing mechanism of the circulating swirl flow 14 with reference to FIGS. 27A to 27C. As shown in FIG. 27A, since the gas near a joint portion (a corner portion) between an upper end portion of the housing 41 and an outer peripheral portion of the upper surface plate 40 is hard to flow due to an influence of a viscous resistance from a wall surface, a stagnation portion 15 is formed. Further, as shown in FIG. 27B, a lower portion of the stagnation portion 15 is pulled by the gas flow (the solid and gas two-phase flow 52) toward the downward flow forming member 13, and the small circulating swirl flow 14 is generated for the first time. Further, if there is installed the downward flow forming member 13 achieving a dam effect with respect to the gas flow, the circulating swirl flow 14 is greatly developed as shown in FIG. 27C, and the solid and gas two-phase flow 52 is pushed down due to the existence of the circulating swirl flow 14.

Further, since the super fine particles trapped by the circulating swirl flow 14 are hard to break away from the circulating swirl flow 14 because of the weak inertia force, and tend to stay within the circulating swirl flow 14. Accordingly, the concentration of the super fine particles here becomes locally higher than the other portions. In the case that the gas temperature is increased due to some reasons, there is a risk that the firing occurs from this portion.

FIG. 28 is a view showing the gas flow in the case that the downward flow forming member 13 is not installed. As is apparent from this drawing, if the downward flow forming member 13 damning the gas flow is not installed in the outer peripheral side of the rotating fins 21, a comparatively small stagnation portion 15 hardly generating the gas flow is formed near a joint portion (a corner portion) between the upper surface plate 40 and the housing 41, and the entire flow of the gas is smooth, and flows into the rotating fins 21 side. In this case, since the downward flow forming member 13 is not installed, there is no coarse particles removing effect generated by the downward flow forming member 13, and a rate at which the coarse particles are mixed into the group of particles taken out from the classifier is high. In this case, in accordance with experimentations, it is confirmed that even if a member such as a baffle plate or the like is installed at a portion of the stagnation portion 15 shown in FIG. 28, the gas flow is not changed, and the rate at which the coarse particles are mixed into the group of particles taken out from the classifier is accordingly high.

In this case, there can be considered that a collision area with the solid and gas two-phase flow 52 is widened by increasing the length of the downward flow forming member 13 in FIG. 24. However, if the downward flow forming member 13 is elongated, an area closing an opening portion of the rotating fins 21 is increased, a pressure loss within the classifier becomes higher, and a classifying efficiency is lowered. Accordingly, this structure is not expedient.

An object of the present invention is to solve the defect of the prior art mentioned above, and to provide a classifier which can stably obtain fine particles while keeping a mixing rate of coarse particles further lower than the conventionally proposed structure, a vertical crusher provided with the classifier, and a coal fired boiler apparatus provided with the vertical crusher.

MEANS FOR SOLVING THE PROBLEM

In order to achieve the object mentioned above, in accordance with a first aspect of the present invention, there is provided a classifier comprising:

a rotating fin executing a classification of solid particles on the basis of a centrifugal force;

a tubular downward flow forming member provided in an outer peripheral side of the rotating fin; and a bowl-shaped recovery cone arranged in a lower side of the rotating fin and the downward flow forming member;

a housing accommodating the rotating fin, the downward flow forming member and the recovery cone, in which a contraction flow region is formed between the housing and the recovery cone, a two-phase flow is constituted by mixture of the solid particles blown up through the contraction flow region from the lower side of the recovery cone and a gas, the particles in the two-phase flow are separated into fine particles and coarse particles by bringing the two-phase flow into collision with the downward flow forming member in an upper portion of the housing so as to form a downward flow, and thereafter conducting the downward flow to the rotating fin side, and the fine particles are taken out while passing through the portion between the rotating fins rotating together with the air flow, wherein a circulating swirl flow development suppressing portion for suppressing a development of a circular swirl flow generated at its position is provided in an upper side of the contraction flow region and at an outer peripheral position of the downward flow forming member.

In accordance with a second aspect of the present invention, there is provided a classifier as recited in the first aspect mentioned above, wherein the circulating swirl flow development suppressing portion is formed by a slant member bridged over an outer peripheral portion of an upper surface plate provided in an upper surface of the housing from an upper portion of a side wall of the housing.

In accordance with a third aspect of the present invention, there is provided a classifier as recited in the first aspect mentioned above, wherein the circulating swirl flow development suppressing portion is formed by bending an upper portion of a side wall of the housing or an outer peripheral portion of an upper surface plate.

In accordance with a fourth aspect of the present invention, there is provided a classifier as recited in the second or third aspect mentioned above, wherein an angle of gradient of the circulating swirl flow development suppressing portion is regulated in a range between 15 and 75 degree.

In accordance with a fifth aspect of the present invention, there is provided a classifier as recited in any one of the second to fourth aspects mentioned above, wherein in the case that a distance from a side wall of the housing to the downward flow forming member is set to L, and a horizontal width from the side wall of the housing to an upper end portion of the circulating swirl flow development suppressing portion is set to W, a ratio W/L is regulated to be equal to or more than 0.15.

In accordance with a sixth aspect of the present invention, there is provided a classifier as recited in any one of the second to fourth aspects mentioned above, wherein in the case that a distance from a side wall of the housing to the downward flow forming member is set to L, and a vertical height from the upper surface plate to a lower end portion of the circulating swirl flow development suppressing portion is set to H3, a ratio H3/L is regulated in a range between 0.15 and 1.

In accordance with a seventh aspect of the present invention, there is provided a classifier as recited in the first aspect mentioned above, wherein the circulating swirl flow development suppressing portion is formed in a circular arc shape in such a manner that an inner side is concaved from an upper portion of a side wall of the housing to an outer peripheral portion of the upper surface plate.

In accordance with an eighth aspect of the present invention, there is provided a classifier as recited in the seventh aspect mentioned above, wherein in the case that a distance from a side wall of the housing to the downward flow forming member is set to L, and a radius of curvature of the circulating swirl flow development suppressing portion is set to R, a ratio R/L is regulated in a range between 0.25 and 1.

In accordance with a ninth aspect of the present invention, there is provided a classifier as recited in any one of the first to eighth aspects mentioned above, wherein in the case that a height in a direction of a rotating axis of the rotating fin is set to Hi, and a height in a direction of a rotating axis of the downward flow forming member is set to H2, a ratio H2/H1 is regulated in a range between ½ and ¼.

In accordance with a tenth aspect of the present invention, there is provided a classifier as recited in any one of the first to ninth aspects mentioned above, wherein a lot of fixed fins are provided between the downward flow forming member and the circulating swirl flow development suppressing portion so as to be fixed at an optional angle with respect to a direction of a rotating axis of the rotating fin.

In accordance with an eleventh aspect of the present invention, there is provided a classifier as recited in any one of the first to tenth aspects mentioned above, wherein a short pass preventing member is provided in an upper portion of the recovery cone.

In accordance with a twelfth aspect of the present invention, there is provided a vertical crusher comprising:

a crushing portion crushing a raw material on the basis of an engagement between a crushing table and a crushing ball or a crushing roller; and a classifier installed in an upper portion of the crushing portion and classifying in a predetermined grain size, wherein the classifier is constituted by the classifier as recited in any one of the first to tenth aspects mentioned above.

In accordance with a thirteenth aspect of the present invention, there is provided a coal fired boiler apparatus comprising:

a vertical crusher provided with a crushing portion crushing a raw material on the basis of an engagement between a crushing table and a crushing ball or a crushing roller, and a classifier installed in an upper portion of the crushing portion and classifying in a predetermined grain size; and the coal fired boiler apparatus burning a pulverized coal having a predetermined grain size and obtained by the vertical crusher, wherein the classifier is constituted by the classifier as recited in any one of the first to tenth aspects mentioned above.

EFFECT OF THE INVENTION

The present invention is structured as mentioned above, and can provide a classifier which can stably obtain fine particles while keeping a mixing rate of coarse particles further lower than the conventionally proposed structure, a vertical crusher provided with the classifier, and a coal fired boiler apparatus provided with the vertical crusher.

BEST MODE FOR CARRYING OUT THE INVENTION

Next, a description will be given of embodiments in accordance with the present invention with reference to the accompanying drawings. FIG. 1 is a view of an outline structure of a vertical crusher provided with a classifier in accordance with a first embodiment, FIG. 2 is a view of a partly outline structure of the classifier, and FIG. 3 is a system view of a coal fired boiler apparatus provided with the crusher.

A description will be given of a system of the coal fired boiler apparatus with reference to FIG. 3. A combustion air A fed from a positive blower 61 is separated into a primary air A1 and a secondary air A2, and the primary air A1 is branched into the air which is directly fed as a cooling air to a vertical crusher 63 by a primary air positive blower 62, and the air which is heated by an exhaust gas type air preheater 64 so as to be fed to the vertical crusher 63. Further, the cold air and the hot air are mixed and regulated such that the mixed air has a proper temperature, and are supplied to the vertical crusher 63.

A coal 50 is put in a coal bunker 65, and is thereafter supplied to the vertical crusher 63 every fixed quantities by a coal feeder 66 so as to be crushed. A pulverized coal crushed while being dried by the primary air A1 so as to be generated is fed to a burner wind box 68 of a coal fired boiler apparatus 67 while being carried by the primary air A1. The secondary air A2 is heated by a steam type air preheater 69 and an exhaust gas type air preheater 64 so as to be fed to the wind box 68, and is provided for burning the pulverized coal within the coal fired boiler apparatus 67.

In the exhaust gas generated by the combustion of the pulverized coal, a dust is removed by a dust collector 70, a nitrogen oxide is reduced by a denitration device 71, the exhaust gas is thereafter sucked by an induced draft fan 72 via the air preheater 64, a sulfur content is removed by a desulfurization device 73, and the exhaust gas is thereafter discharged to the ambient air from a chimney 74.

The vertical crusher 63 is mainly constituted by a crushing portion 5, and a classifier 6 installed in an upper side thereof, as shown in FIG. 1. A coal 50 supplied from a coal feeder 1 comes down to a center portion of a rotating crushing table 2 as shown by an arrow, is moved to an outer peripheral side of the crushing table 2 on the basis of a centrifugal force generated in connection with the rotation of the crushing table 2, and is engaged between the crushing table 2 and the crushing ball 3 so as to be crushed.

The crushed particles are blown upward while being dried by a hot wind 51 introduced from a throat 4. The particles having a large grain size in the blown-up particles come down in the middle of being carried to the classifier 6, and are returned to the crushing portion 5 (a primary classification).

The group of particles reaching the classifier 6 are classified into the fine particles and the coarse particles (a secondary classification), and the coarse particles come down to the crusher 5 so as to be again crushed. On the other hand, the fine particles getting out of the classifier 6 are fed as a fuel to the coal fired boiler apparatus 67 from a discharge pipe 7 (refer to FIG. 3).

The classifier 6 is formed as a two-state structure comprising a fixed type classifying mechanism 10 and a rotary type classifying mechanism 20. The fixed type classifying mechanism 10 has a fixed fin 12 and a recovery cone 11.

The fixed fin 12 is suspended from an upper surface plate 40, and a lot of fixed fins 12 are coupled to an upper end portion of the recovery cone 11 at an optional angle with respect to a direction of a center axis of the classifier 6. The recovery cone 11 is provided in lower side of the fixed fins 12 so as to be formed as a bowl shape, and the coarse particles recovered by the recovery cone 11 come down to the crushing portion 5 so as to be again crushed.

The rotary type classifying mechanism 20 has a motor 24, a rotating shaft 22 rotationally driven by the motor 24, and a rotating fin 21 coupled to a lower portion of the rotating shaft 22. The rotating fin 21 extends approximately in parallel to the direction of the center axis (the direction of the rotating shaft) of the classifier 6 in a longitudinal direction of the plate, and a lot of rotating fins 21 are arranged at an optional angle with respect to the direction of the center axis of the classifier 6. Upper end portions of the rotating fins 21 are close to each other at a slight gap with respect to the upper surface plate 40.

A cylindrical downward flow forming member 13 suspended from the upper surface plate 40 is arranged in an outer peripheral side of the rotating fin 21 and at an approximately middle position of the fixed fin 12 and the rotating fin 21. Outer diameters of the downward flow forming member 13 and the rotating fin 21 are smaller than an inner diameter of an upper end portion of the recovery cone 11, and the downward flow forming member 13 and the rotating fin 21 are arranged in an inner side of the recovery cone 11. Further, a contraction flow region 16 narrowing step by step toward an upper side is formed by a side wall of the bowl-shaped recovery cone 11 and a side wall of the housing 41.

A circulating swirl flow development suppressing portion 30 for suppressing a development of the circulating swirl flow 14 shown in FIG. 27 is provided in a joint portion (a corner portion) between an upper end portion of the housing 41 and an outer peripheral portion of the upper surface plate 40. FIG. 4 is a bottom elevational view of the circulating swirl flow development suppressing portion 30, and FIG. 5 is an enlarged cross sectional view of a portion near the circulating swirl flow development suppressing portion 30.

In the case of the present embodiment, the circulating swirl flow development suppressing portion 30 is provided along an inner periphery of the housing 41 by connecting a plurality of flat circular arc-shaped plates 31 as shown in FIG. 4. As shown in FIG. 4, each of the circular arc-shaped plates 31 is supported by a support plate 32 installed in the corner portion and having an approximately triangular side elevational shape. As shown in FIGS. 1 and 2, an inner slant surface of the circulating swirl flow development suppressing portion 30 faces to the downward flow forming member 13.

As shown in FIG. 2, in the case that a height in an axial direction of the rotating fin 21 is set to Hi, and a height in an axial direction of the downward flow forming member 13 is set to H2, a dimensional ratio H2/H1 is set to 0.33 (⅓) in the present embodiment. Further, the downward flow forming member 13 is installed at an intermediate position between the fixed fin 12 and the rotating fin 21. Further, in the case that a distance from the side wall of the housing 41 to the downward flow forming member 13 is set to L, a horizontal width from the side wall of the housing 41 to an upper end portion of the circulating swirl flow development suppressing portion 30 is set to W, a vertical height from the upper surface plate 40 to a lower end portion of the circulating swirl flow development suppressing portion 30 is set to H3, and an angle of gradient of the circulating swirl flow development suppressing portion 30 is set to θ, the angle of gradient θ=45 degree, H3/W=1, and H3/L=W/L=0.35 in the present embodiment.

It is preferable that the dimensional ratio H2/H1 is set to a range between ½ and ¼. If the ratio H2/H1 is more than ½, a pressure loss is increased due to an existence of the downward flow forming member 13. On the other hand, if the ratio H2/H1 becomes smaller than ¼, a function of the downward flow forming member 13 is not sufficiently achieved.

FIG. 6 is a view showing a gas flow pattern in accordance with a flow numerical analysis within the classifier in accordance with the present embodiment. As is apparent from this drawing, since the circulating swirl flow development suppressing portion 30 is provided in an inner peripheral surface side of the housing 41 in which the circulating swirl flow 14 is generated and developed by installing the downward flow forming member 13, it is possible to suppress the generation and development of the circulating swirl flow 14, and an interference of the circulating swirl flow 14 is lost. Accordingly, the gas forms an ideal flow extending along the downward flow forming member 13 from the upper surface plate 40.

FIG. 7 is a view showing a locus of the group of particles within the classifier in accordance with the present embodiment. Since the interference of the circulating swirl flow 14 is lost, the group of particles come up to a portion near the upper surface plate 40, and come down along the downward flow forming member 13. Accordingly, it is known that the separating function of the coarse particles by the downward flow forming member 13 is effectively achieved.

As is not illustrated in FIG. 7, when the solid and gas two-phase flow 52 coming into collision with the downward flow forming member 13 is changed to a downward flow moving downward by a gravity, the coarse particles having the great gravity and the great downward inertia force are separated from the flow, and come down to the lower portion along the inner wall of the recovery cone 11. Accordingly, the group of particles hardly including the coarse particles reach the rotating fin 21. Further, the particles are further separated into the coarse particles and the fine particles by a centrifugal force of the rotating fin 21, and the coarse particles are flipped by the rotating fin 21 so as to come into collision with the downward flow forming member 13 or directly come down on the recovery cone 11. The separated fine particles are taken out from the classifier after passing through the portion between the rotating fins 21 rotating in connection with the air flow.

FIG. 8 is a characteristic view showing a result obtained by measuring a change of a mixed rate of the coarse particles of 100 mesh over included in the fine particles in 200 mesh pass taken out from the classifier in the case that the angle θ of gradient of the circulating swirl flow development suppressing portion 30 is fixed to 45 degree, and the ratio H3/L (W/L) shown in FIG. 2 is changed.

As is apparent from this drawing, if the ratio H3/L (W/L) becomes equal to or more than 0.15, the coarse particles mixed rate is significantly reduced. Accordingly, if the ratio H3/L (W/L) is set to be equal to or more than 0.15 (0.15 to 1), preferably 0.2 to 1, further preferably 0.35 to 1, it is possible to obtain the sharp fine particles having such a grain size distribution that the coarse particles are hardly mixed. The description is given of the case that the angle θ of gradient of the circulating swirl flow development suppressing portion 30 is set to 45 degree in FIG. 8, however, it is confirmed by experiments that it is preferable to regulate the ratio H3/L (W/L) in the manner mentioned above even if the angle θ of gradient is deviated in some degree.

FIG. 9 is a characteristic view showing a result obtained by measuring the change of the mixed rate of the coarse particles of 100 mesh over in the case of changing the angle θ of gradient of the circulating swirl flow development suppressing portion 30 while fixing the ratio H3/L or W/L to 0.15. A solid line in the drawing is a characteristic curve in the case of changing the angle θ of gradient while fixing the ratio H3/L to 0.15, and a dotted line is a characteristic curve in the case of changing the angle θ of gradient while fixing the ratio W/L to 0.15.

As is apparent from this drawing, if the angle θ of gradient of the circulating swirl flow development suppressing portion 30 is set within a range between 15 and 75 degree, preferably between 30 and 60 degree, it is possible to reduce the mixed rate of the coarse particles. The description is given in FIG. 9 of the case that the ratio H3/L or W/L is fixed to 0.15. However, it is confirmed by experiments that the angle θ of gradient of the circulating swirl flow development suppressing portion 30 is regulated as mentioned above even if the ratio H3/L or W/L is deviated in some degree.

FIG. 10 is a view of a partly outline structure of a classifier in accordance with a second embodiment. In the case of the present embodiment, the circulating swirl flow development suppressing portion 30 is formed by bending an upper end portion of the housing 41 at a predetermine magnitude toward the downward flow forming member 13 side. In the present embodiment, the circulating swirl flow development suppressing portion 30 is formed in the upper end portion of the housing 41, however, the circulating swirl flow development suppressing portion 30 may be formed by sloping the outer peripheral portion of the upper surface plate 40.

FIG. 11 is a view of a partly outline structure of a classifier in accordance with a third embodiment. In the case of the present embodiment, the circulating swirl flow development suppressing portion 30 is extended to a root portion of the fixed fin 12.

FIG. 12 is a view of a partly outline structure of a classifier in accordance with a fourth embodiment. In the case of the present embodiment, the circulating swirl flow development suppressing portion 30 is extended to a root portion of the downward flow forming member 13. Accordingly, in this case, the ratio W/L=1 is established.

FIG. 13 is a view showing a locus of the group of particles in this embodiment, the particles reach the root portion of the downward flow forming member 13, and the coarse particle separating effect of the downward flow forming member 13 is effectively achieved. In the present embodiment, the member constituting the circulating swirl flow development suppressing portion 30 and the upper surface plate 40 are separately formed, however, the structure may be made such that the portion near the outer peripheral portion of the upper surface plate 40 is bent diagonally downward, and the circulating swirl flow development suppressing portion 30 is formed by the bent portion.

FIG. 14 is a view of a partly outline structure of a classifier in accordance with a fifth embodiment. In the case of the present embodiment, the circulating swirl flow development suppressing portion 30 is formed in a circular arc shape in such a manner that an inner side is concaved so as to smoothly connect from the upper end portion of the housing 41 to the outer peripheral portion of the upper surface plate 40. In the case that a radius of the circular arc-shaped circulating swirl flow development suppressing portion 30 is set to R, the relation R<L is established in the present embodiment. The complete circular arc-shaped circulating swirl flow development suppressing portion 30 is installed in FIG. 14, however, the circulating swirl flow development suppressing portion 30 may be formed in such a manner as to draw a parabolic circular arc.

FIG. 15 is a view showing a gas flow pattern in accordance with a flow numerical analysis within the classifier in the case that the relation R=L is established. The solid and gas two-phase flow blown up after passing through the contraction flow region 16 smoothly flows to the downward flow forming member 13 side along the circular arc-shaped circulating swirl flow development suppressing portion 30.

FIG. 16 is a view showing a locus of the group of particles within the classifier in accordance with the present embodiment, the group of particles smoothly flow to the downward flow forming member 13 side along the circular arc-shaped circulating swirl flow development suppressing portion 30, and the coarse particles separating effect of the downward flow forming member 13 is effectively achieved.

FIG. 17 is a characteristic view showing a relation between the ratio R/L of the classifier having the circular arc-shaped circulating swirl flow development suppressing portion 30 and the coarse particles mixed rate of 100 mesh over. As is apparent from this drawing, it is possible to considerably reduce the coarse particles mixed rate by setting the ratio R/L to be equal to or less than 0.25 (0.25 to 1), preferably 0.4 to 1, and further preferably 0.6 to 1.

FIG. 18 is a view of a partly outline structure of a classifier in accordance with a sixth embodiment. In the case of the present embodiment, a short pass preventing member 17 is provided in the lower end portion of the fixed fin 12 or the upper end portion of the recovery cone 11. Since the short pass preventing member 17 is provided as mentioned above, it is possible to prevent the fine particles included in the solid and gas two-phase flow coming up from the lower side from being sucked into the downward flow formed by the downward flow forming member 13 so as to come down on the recovery cone 11 without reaching the rotating fin 21, whereby it is possible to avoid an unnecessary recirculating of the fine particles. The short pass preventing member 17 may be installed in the upper end portion of the recovery cone 11 shown in the next FIG. 19.

FIG. 19 is a view of a partly outline structure of a classifier in accordance with a seventh embodiment. In the case of the present embodiment, the installation of the fixed fin 12 is omitted. It is possible to easily install the comparatively large circulating swirl flow development suppressing portion 30, for example, the circulating swirl flow development suppressing portion 30 having the relation W/L=1 shown in FIG. 12, or the relation R/L=1 shown in FIG. 15, by omitting the fixed fin 12 as mentioned above.

FIG. 20 is a view showing a result of a mixed rate (an absolute value) of the coarse particles of 100 mesh over included in the product fine particles having the grain size distribution of 200 mesh pass, in the classifier in accordance with the first embodiment of the present invention shown in FIG. 1 (a curve A), the conventional classifier shown in FIG. 21 (a curve B) and the conventionally proposed classifier shown FIG. 24 (a curve C).

As is apparent from this drawing, the mixed rate of the coarse particles is reduced by half in the conventionally proposed classifier (the curve C) in comparison with the conventional classifier (the curve B), however, it can be further reduced in the classifier (the curve A) in accordance with the present invention on the basis of a synergetic effect of the downward flow forming member and the circulating swirl flow development suppressing portion, so that the classifier in accordance with the present invention can make the mixed rate of the coarse particles ¼ to ⅓ in comparison with the conventional classifier.

INDUSTRIAL APPLICABILITY

The description is given of the crushing and the classification of the coal in the embodiments mentioned above, however, the present invention is not limited to this, but can be applied to the crushing and the classification of various solids, for example, a cement, a ceramic, a metal, a biomass and the like.

In the embodiments mentioned above, the description is given of the vertical ball mill, however, the present invention is not limited to this, but can be applied to a vertical roller mill.

DESCRIPTION OF REFERENCE NUMERALS

Figure 1:
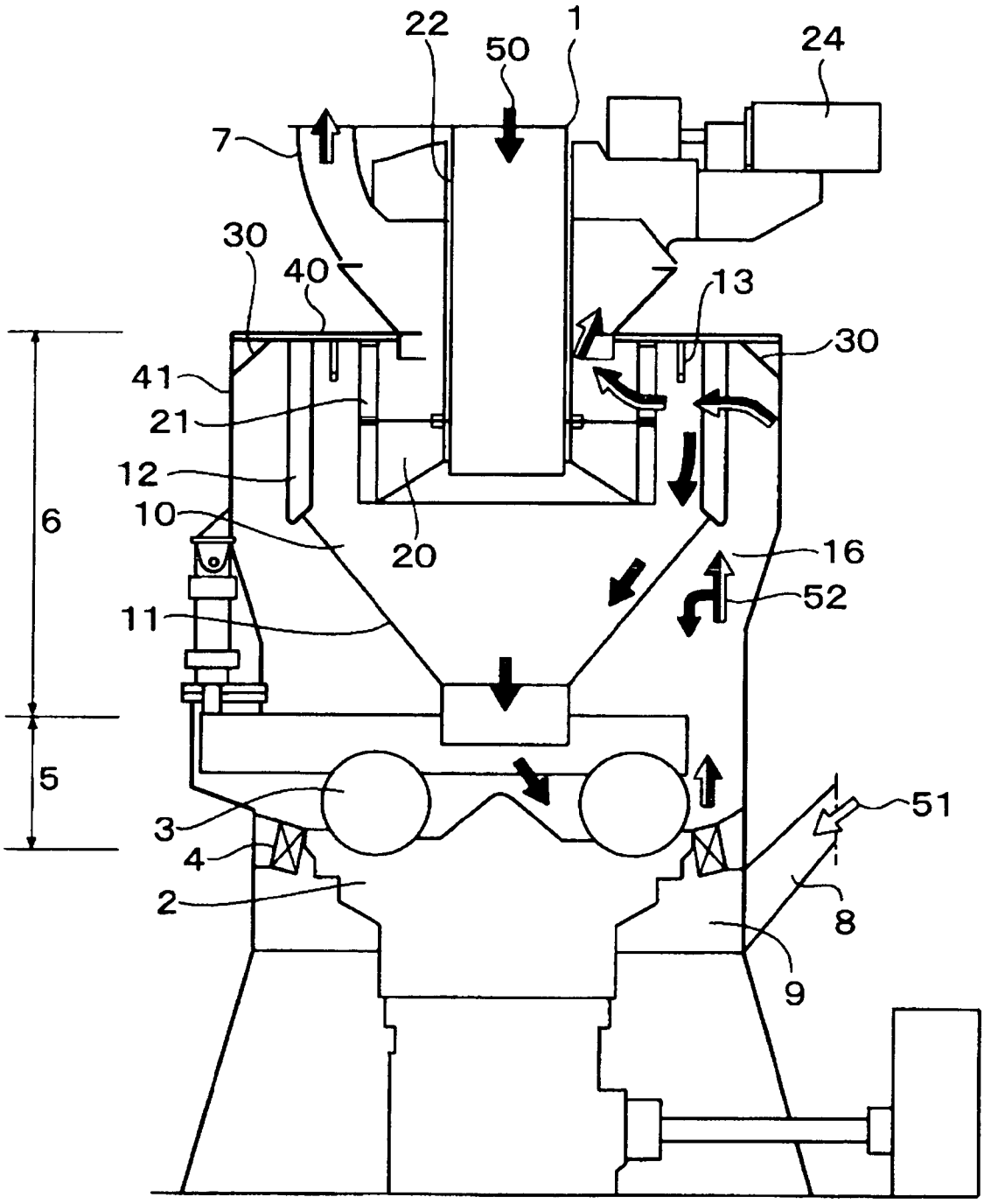
FIG. 1 is a view of an outline structure of a vertical crusher provided with a classifier in accordance with a first embodiment of the present invention.
Figure 2:
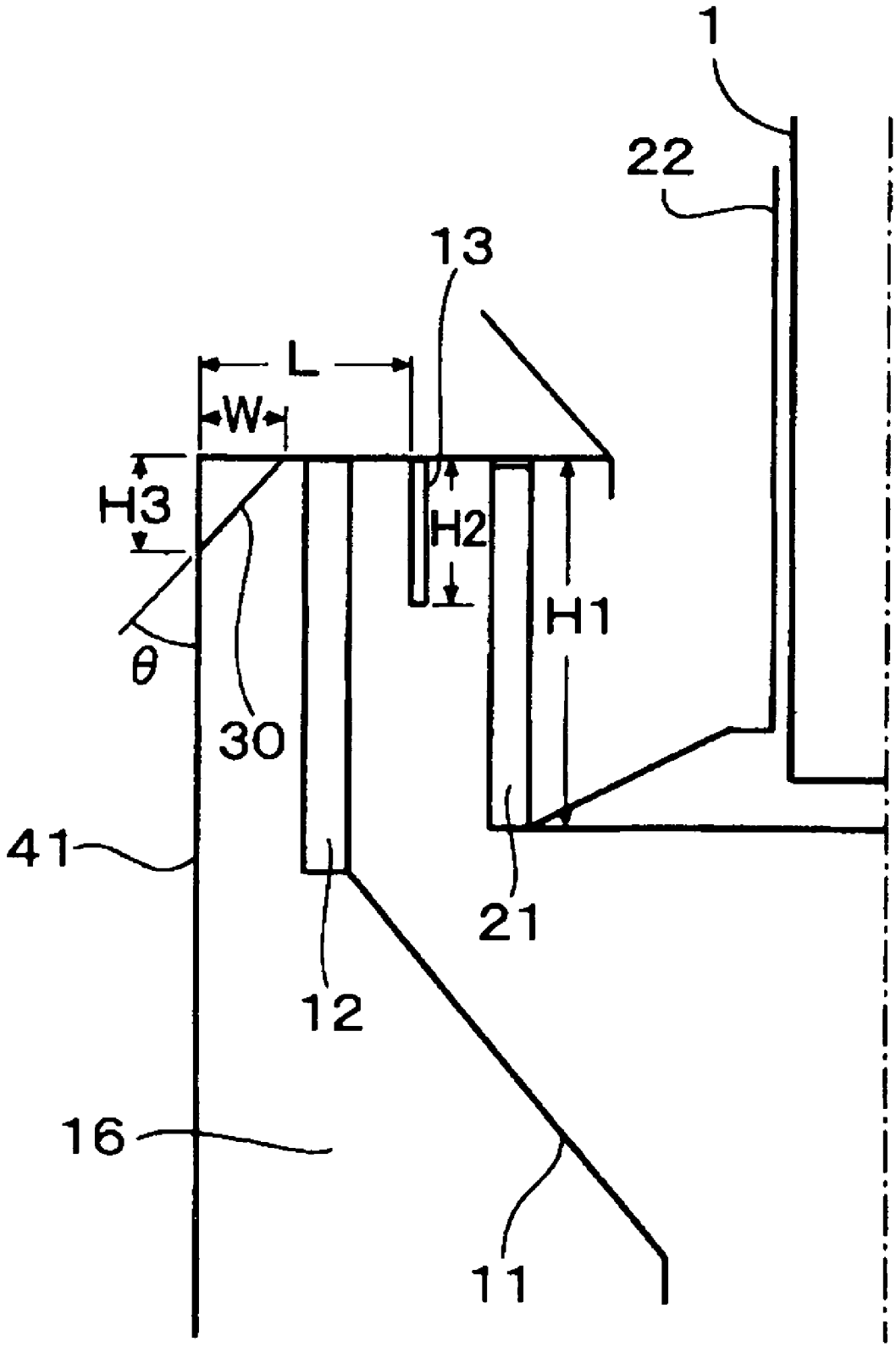
FIG. 2 is a view of a partly outline structure of the classifier.
Figure 3:
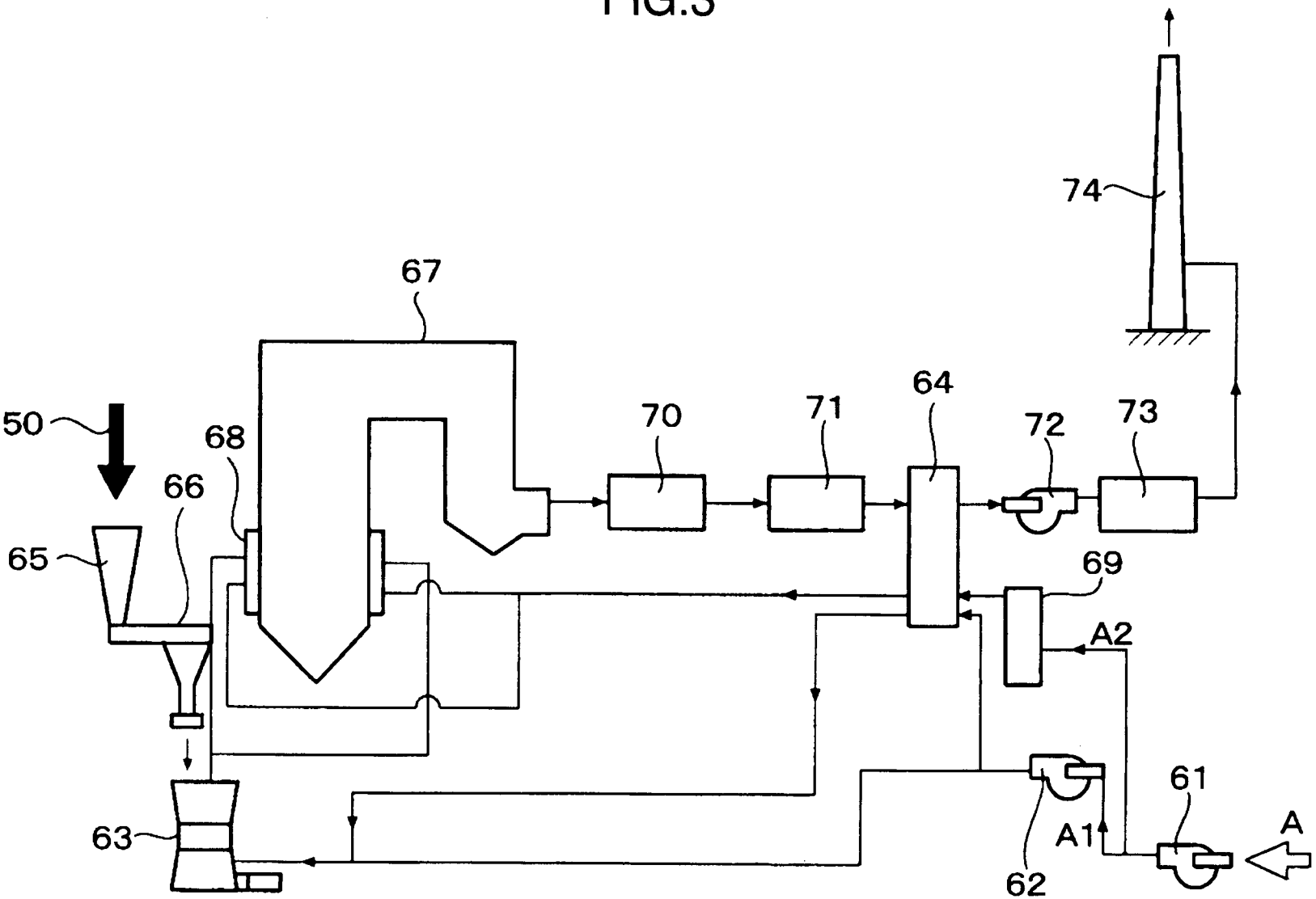
FIG. 3 is a system view of a coal fired boiler apparatus provided with the vertical crusher.
Figure 4:
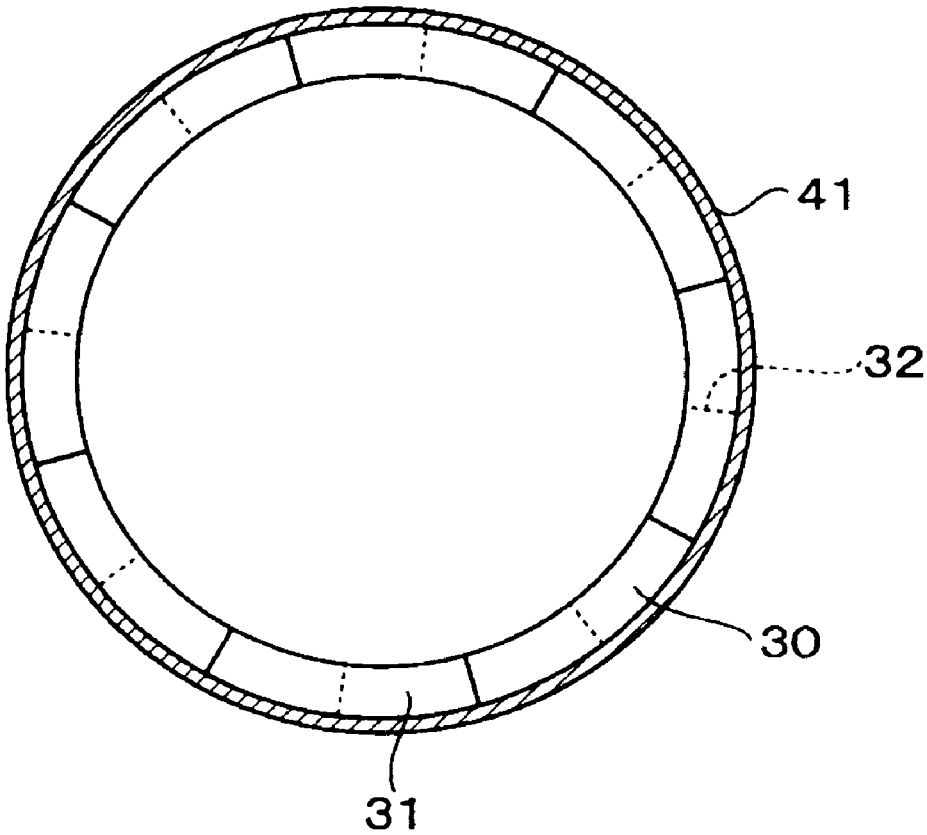
FIG. 4 is a bottom elevational view of a circulating swirl flow development suppressing portion provided in the classifier.
Figure 5:
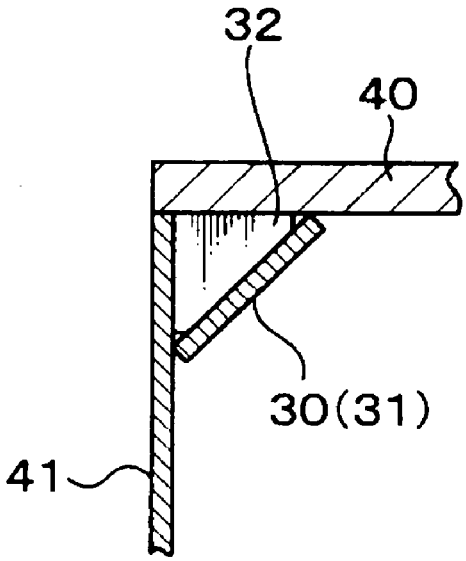
FIG. 5 is an enlarged cross sectional view of a portion near the circulating swirl flow development suppressing portion.
Figure 6:
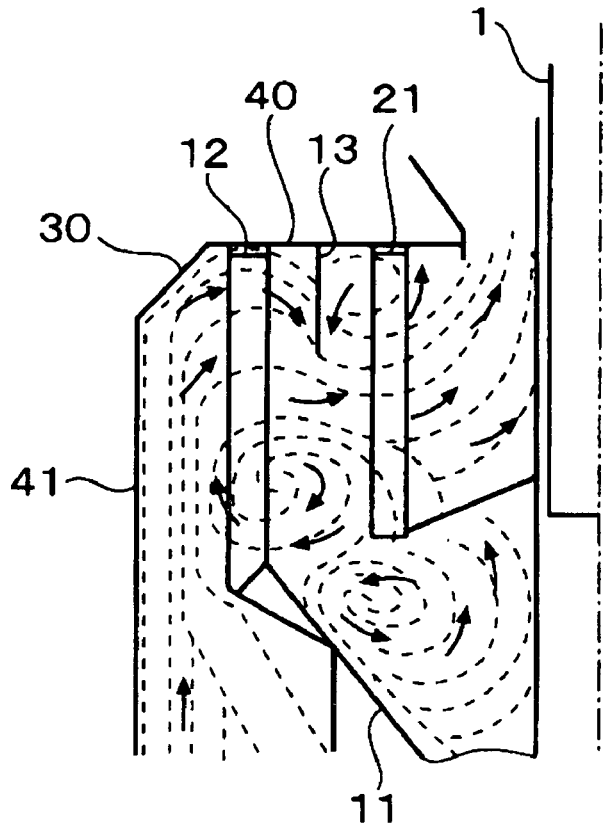
FIG. 6 is a view showing a gas flow pattern in accordance with a flow numerical analysis within the classifier.
Figure 7:
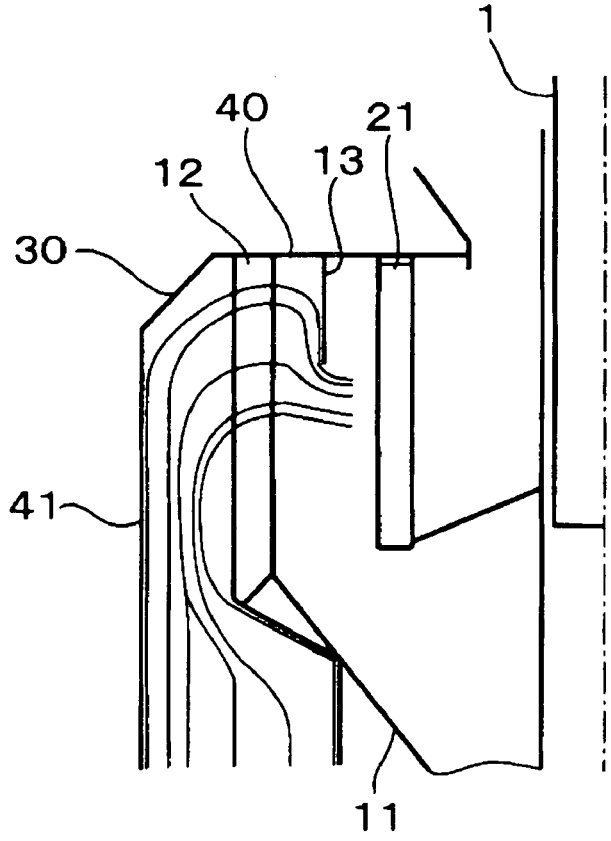
FIG. 7 is a view showing a locus of a group of particles within the classifier.
Figure 8:
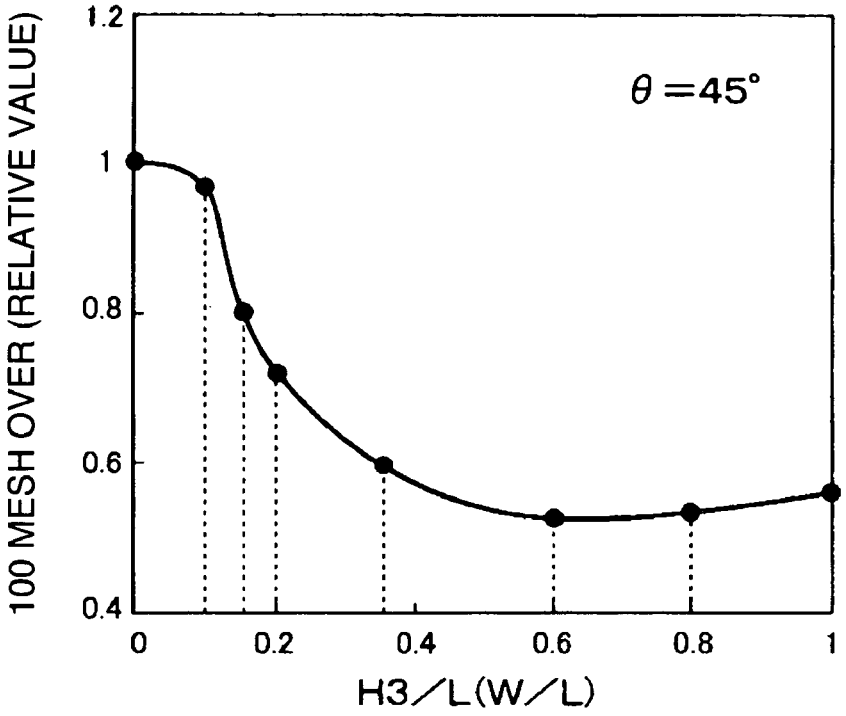
FIG. 8 is a characteristic view showing a relation between a ratio H3/L and a coarse particles mixed rate in the classifier.
Figure 9:
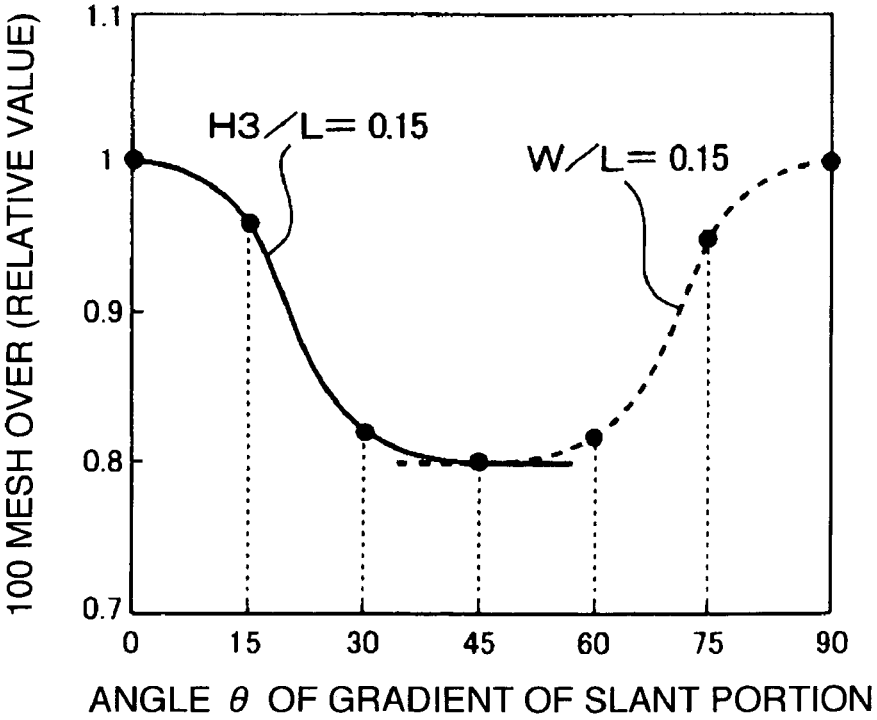
FIG. 9 is a characteristic view showing a relation between an angle of gradient of the circulating swirl flow development suppressing portion and the coarse particles mixed rate in the classifier.
Figure 10:
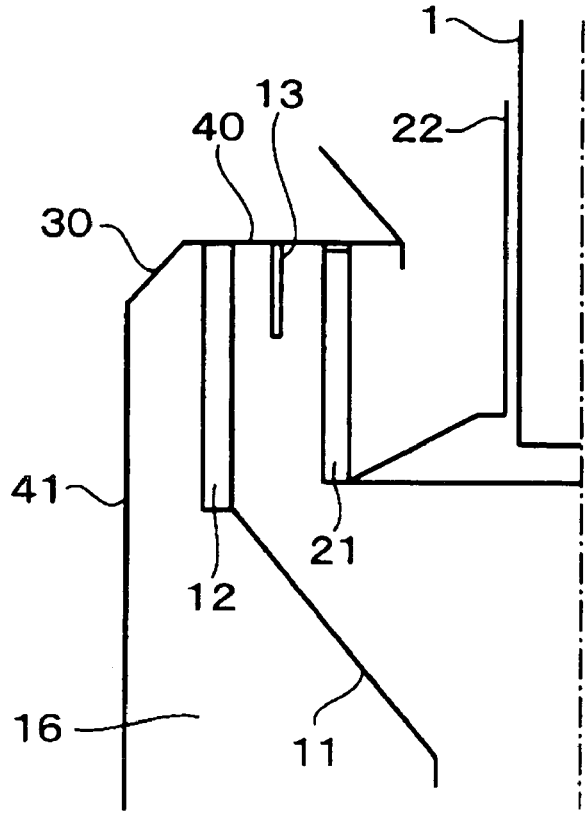
FIG. 10 is a view of a partly outline structure of a classifier in accordance with a second embodiment of the present invention.
Figure 11:
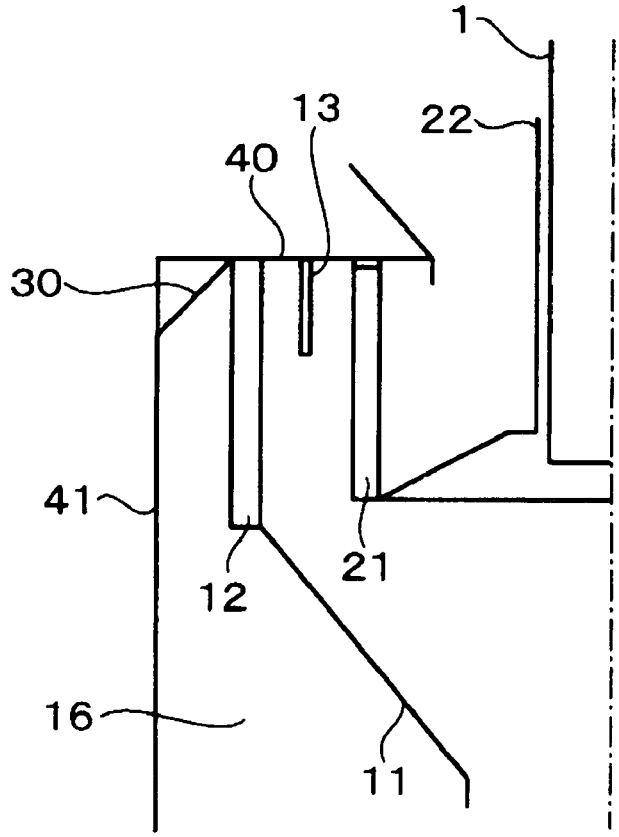
FIG. 11 is a view of a partly outline structure of a classifier in accordance with a third embodiment of the present invention.
Figure 12:
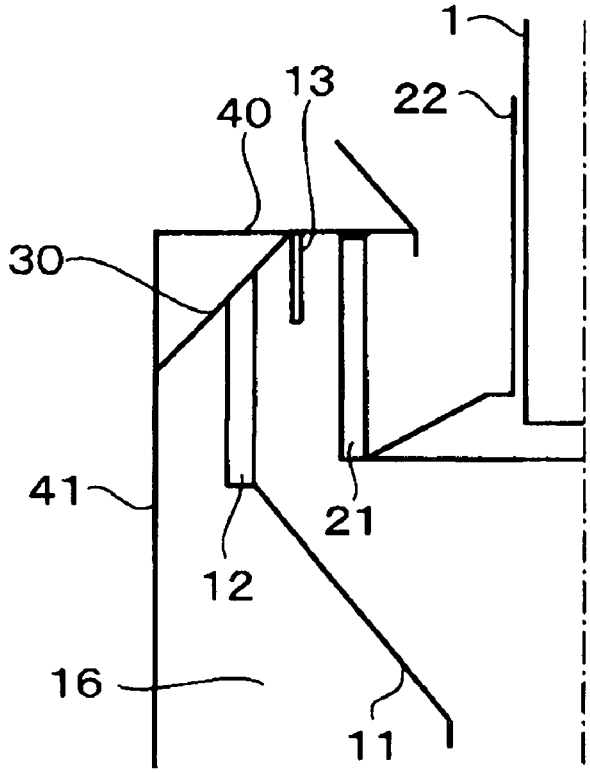
FIG. 12 is a view of a partly outline structure of a classifier in accordance with a fourth embodiment of the present invention.
Figure 13:
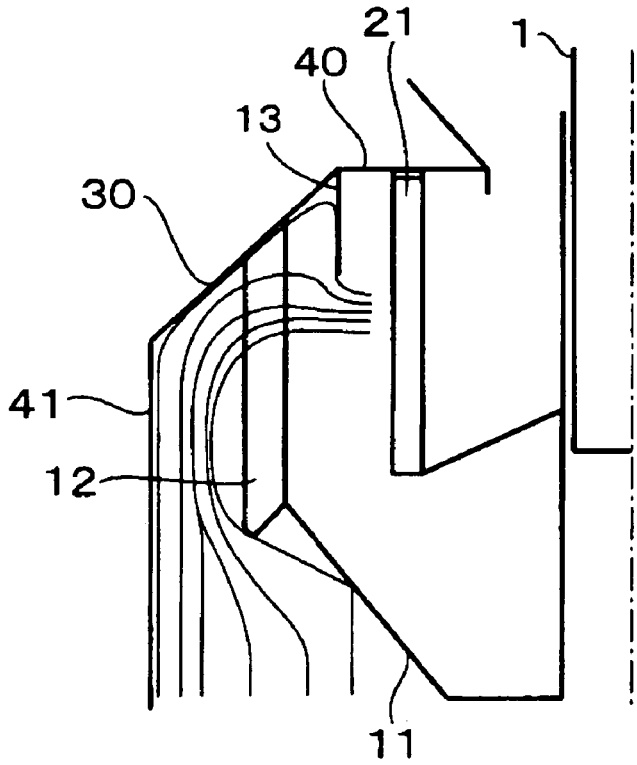
FIG. 13 is a view showing a locus of a group of particles within the classifier.
Figure 14:
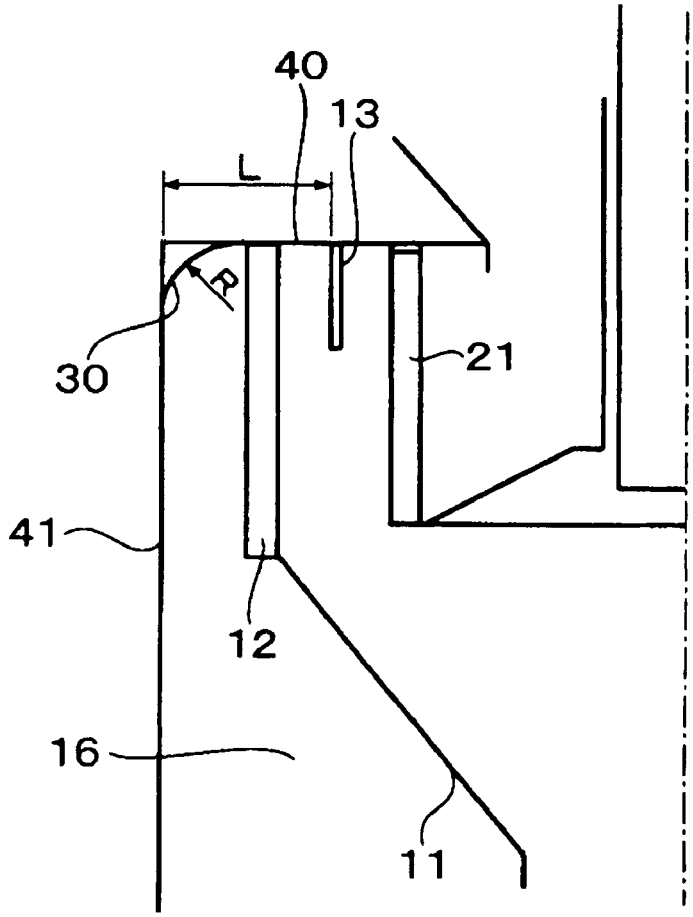
FIG. 14 is a view of a partly outline structure of a classifier in accordance with a fifth embodiment of the present invention.
Figure 15:
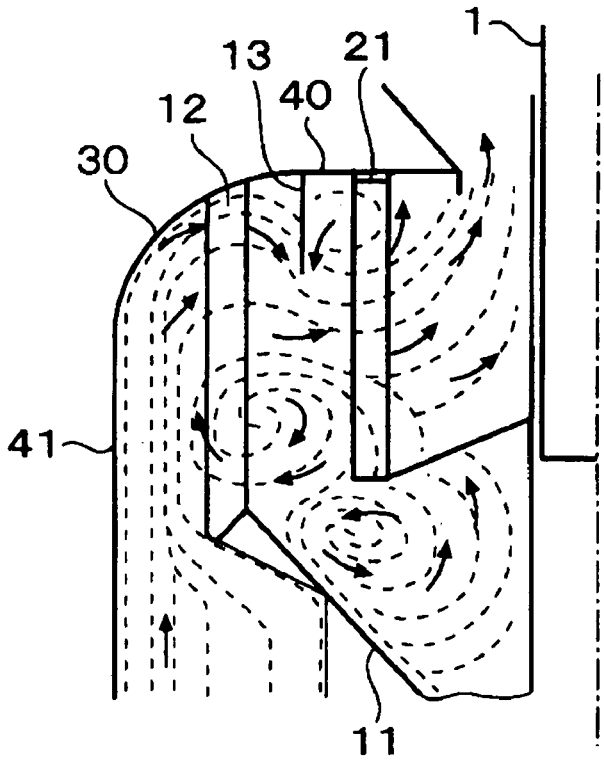
FIG. 15 is a view showing a gas flow pattern in accordance with a flow numerical analysis within the classifier.
Figure 16:
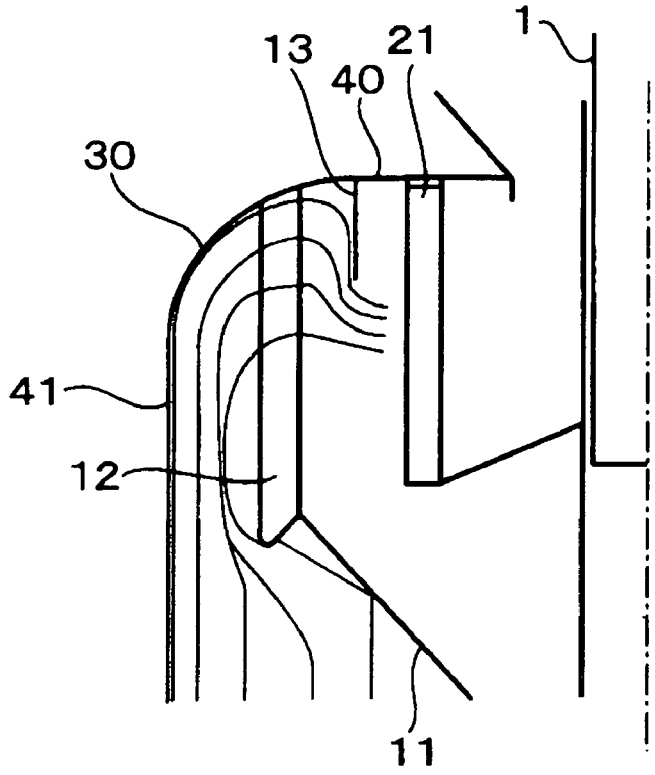
FIG. 16 is a view showing a locus of the group of particles within the classifier.
Figure 17:
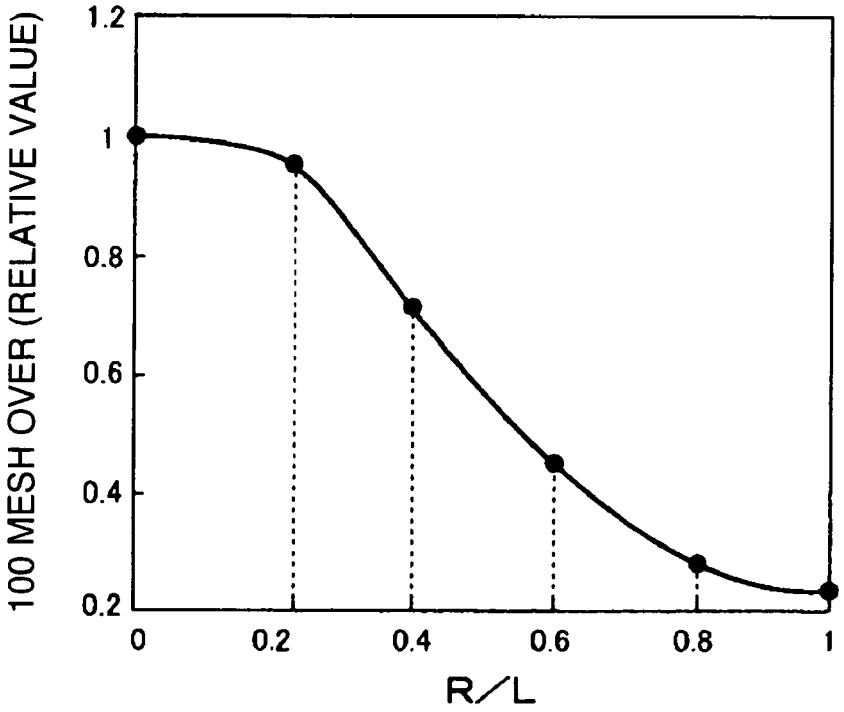
FIG. 17 is a characteristic view showing a relation between a ratio R/L and the coarse particles mixed rate in the classifier.
Figure 18:
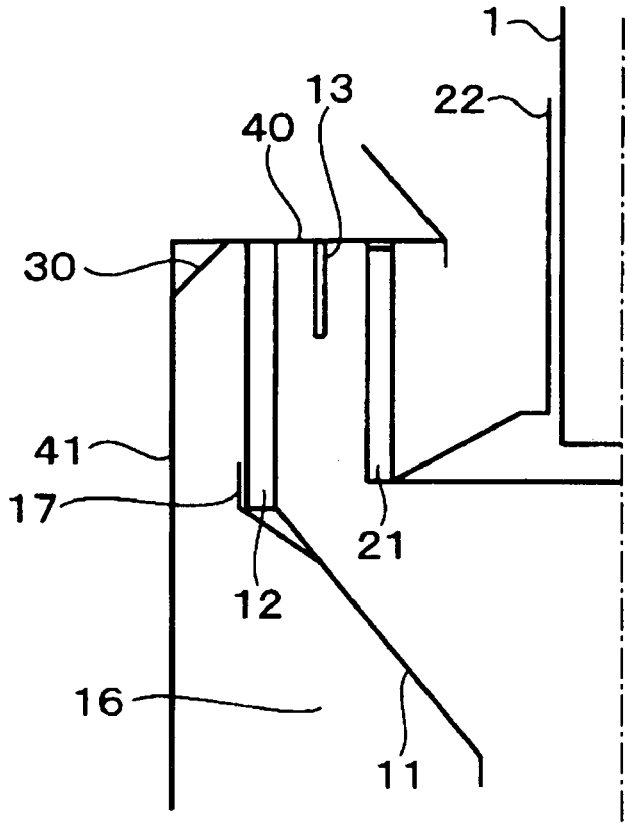
FIG. 18 is a view of a partly outline structure of a classifier in accordance with a sixth embodiment of the present invention.
Figure 19:
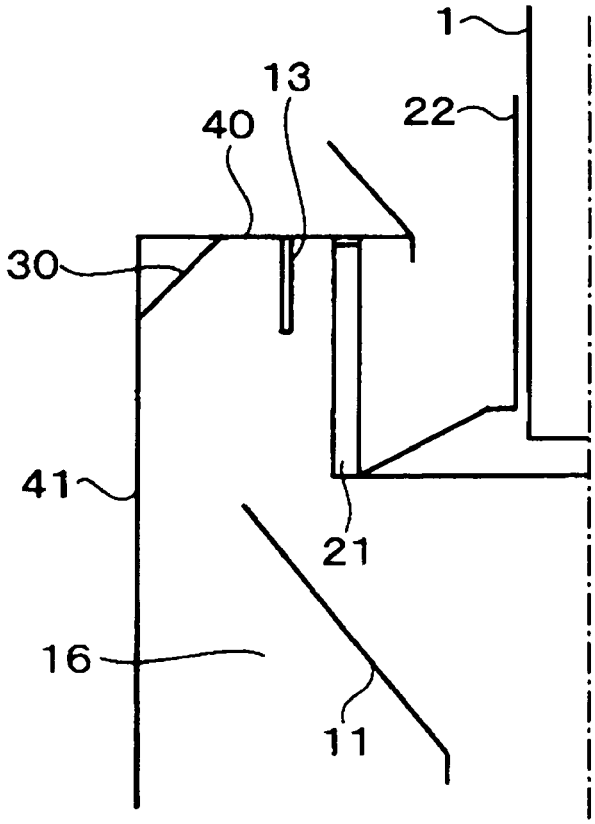
FIG. 19 is a view of a partly outline structure of a classifier in accordance with a seventh embodiment of the present invention.
Figure 20:
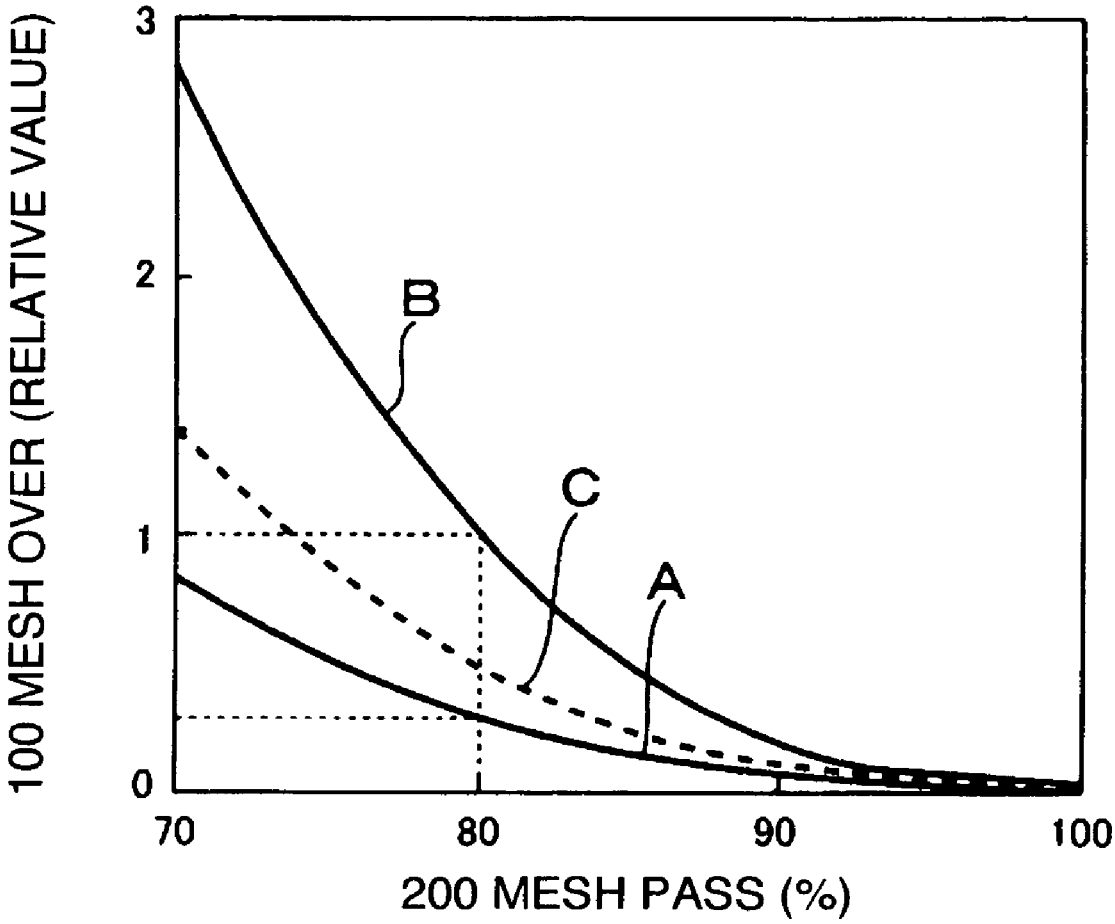
FIG. 20 is a view showing a result obtained by measuring a mixed rate of the coarse particles of 100 mesh over included in product fine particles having a grain size distribution of 200 mesh pass, in the classifier in accordance with the first embodiment of the present invention and the conventional classifier.
Figure 21:
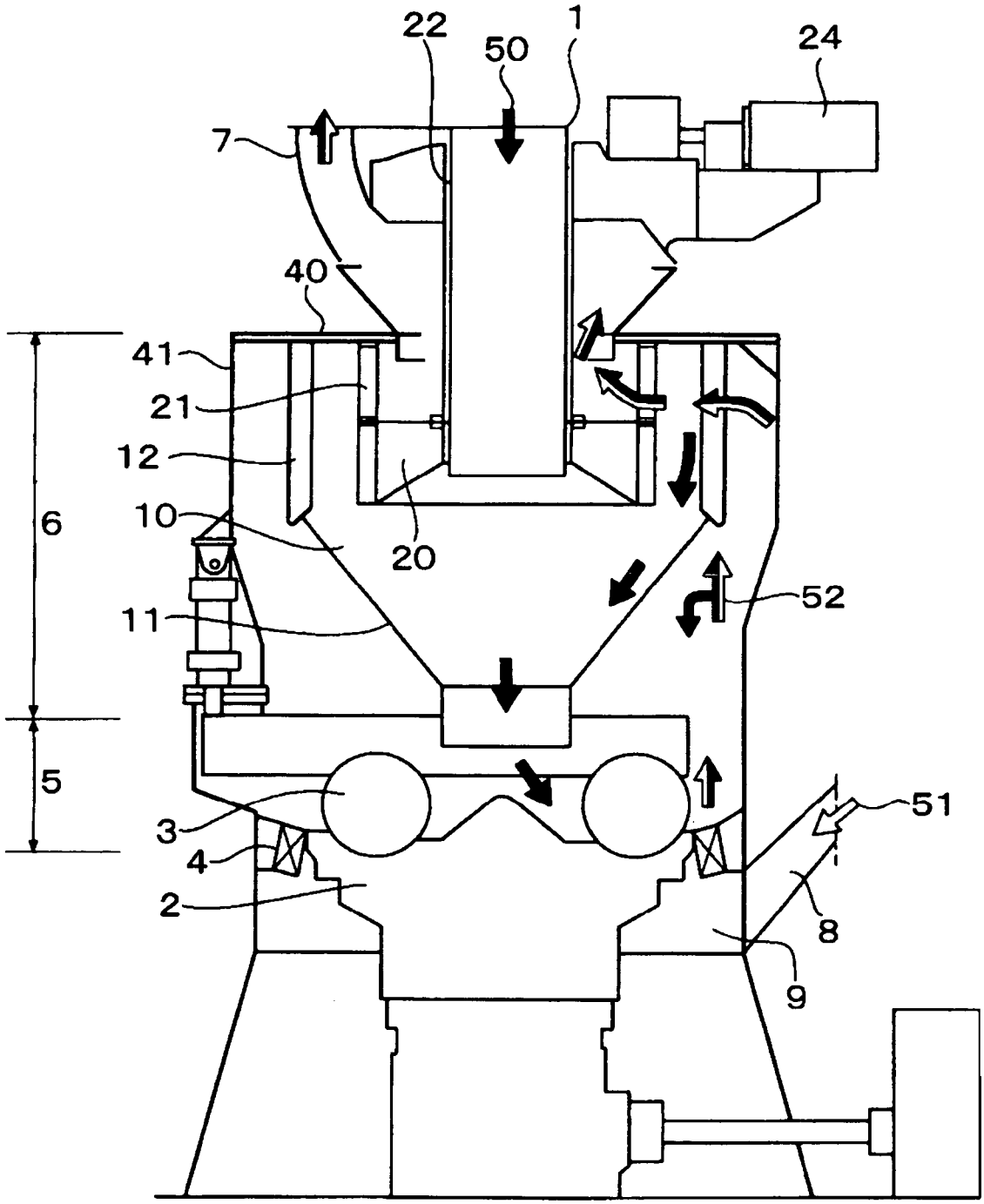
FIG. 21 is a view of an outline structure of a vertical crusher provided with a conventional classifier.
Figure 22:
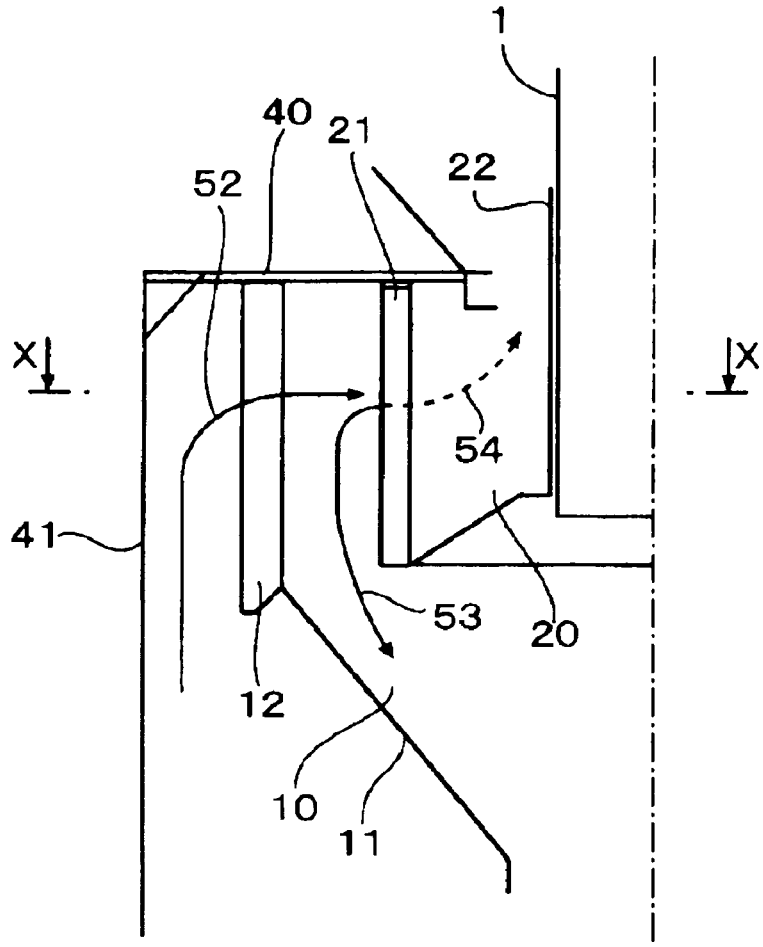
FIG. 22 is a view of a partly outline structure of the classifier.
Figure 23:
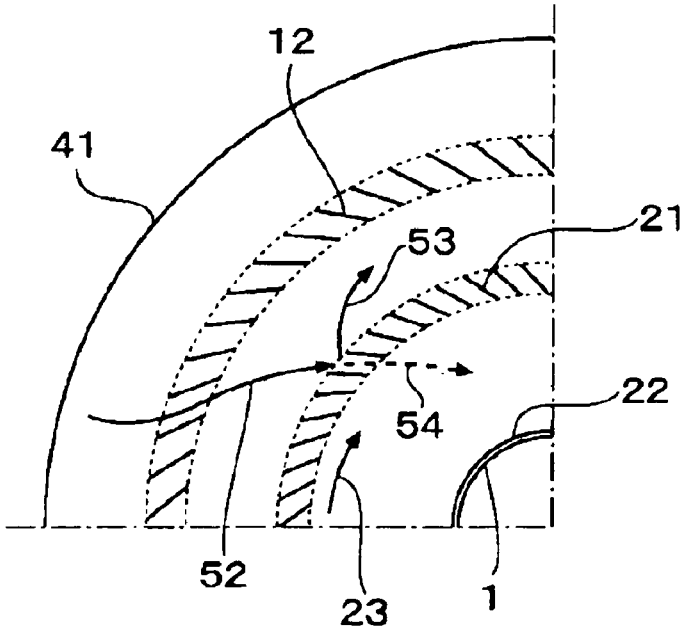
FIG. 23 is a cross sectional view along a line X-X in FIG. 21.
Figure 24:
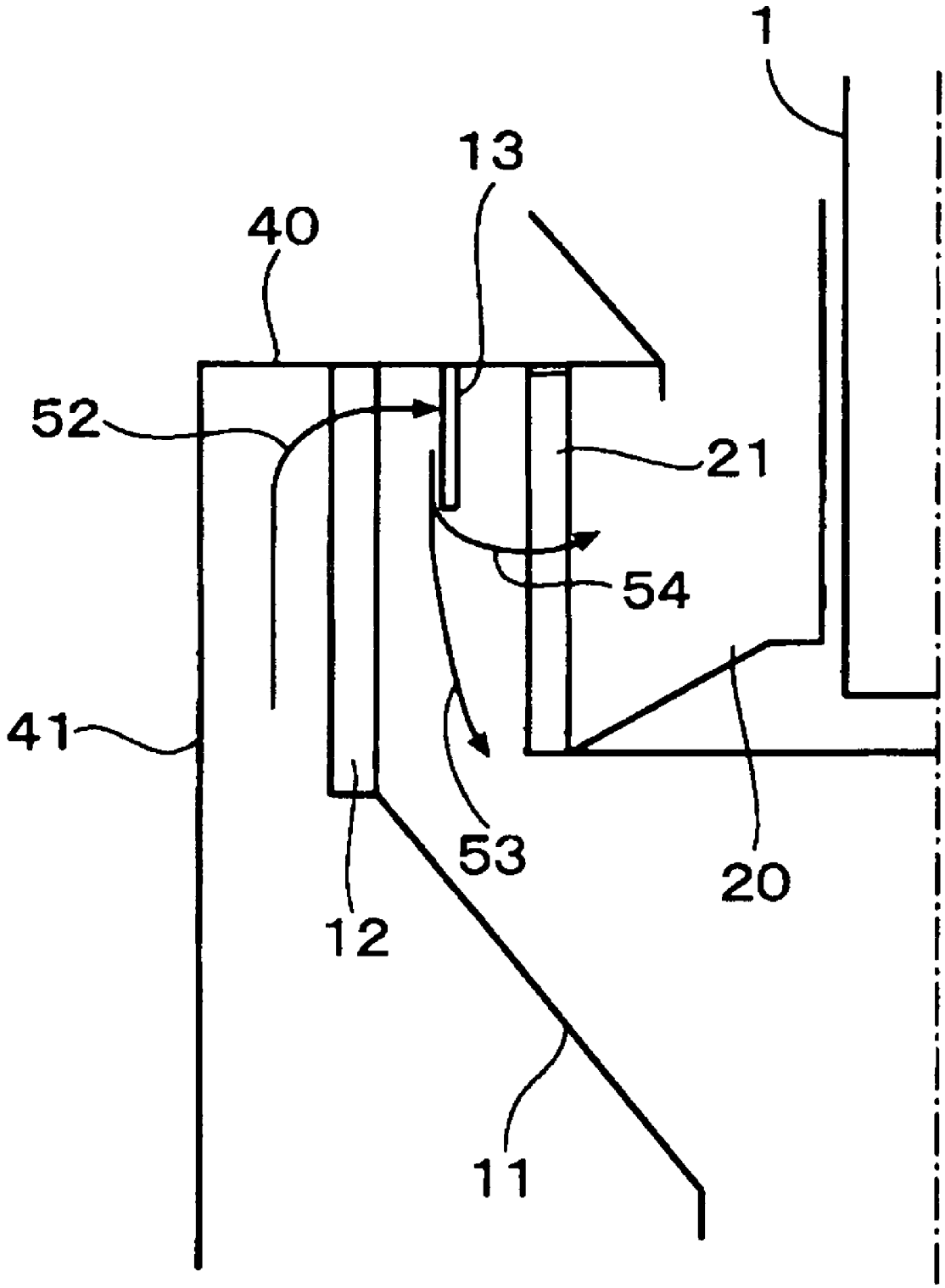
FIG. 24 is a view of a partly outline structure of a conventionally proposed classifier.
Figure 25:
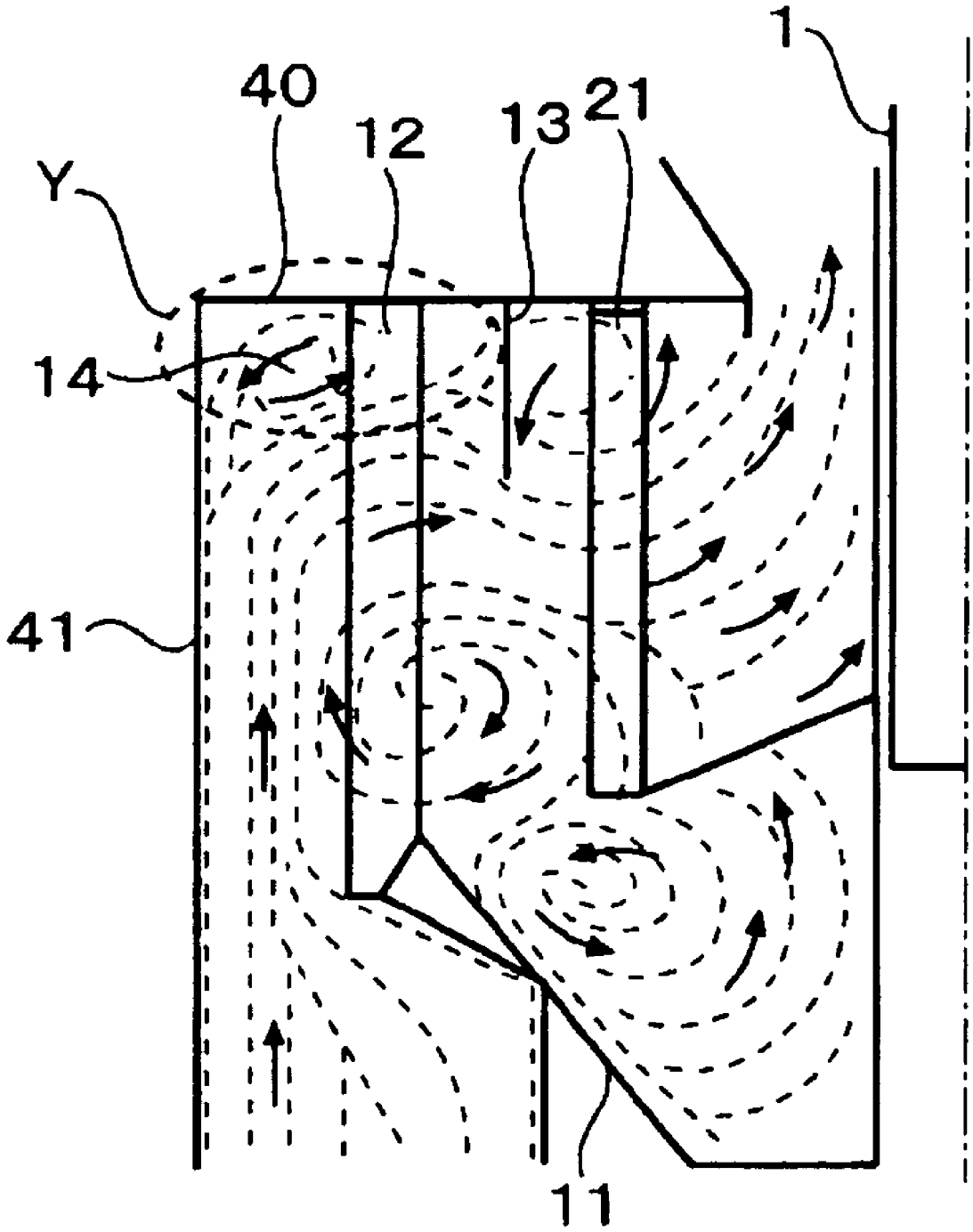
FIG. 25 is a view showing a gas flow pattern in accordance with a flow numerical analysis within the classifier.
Figure 26:
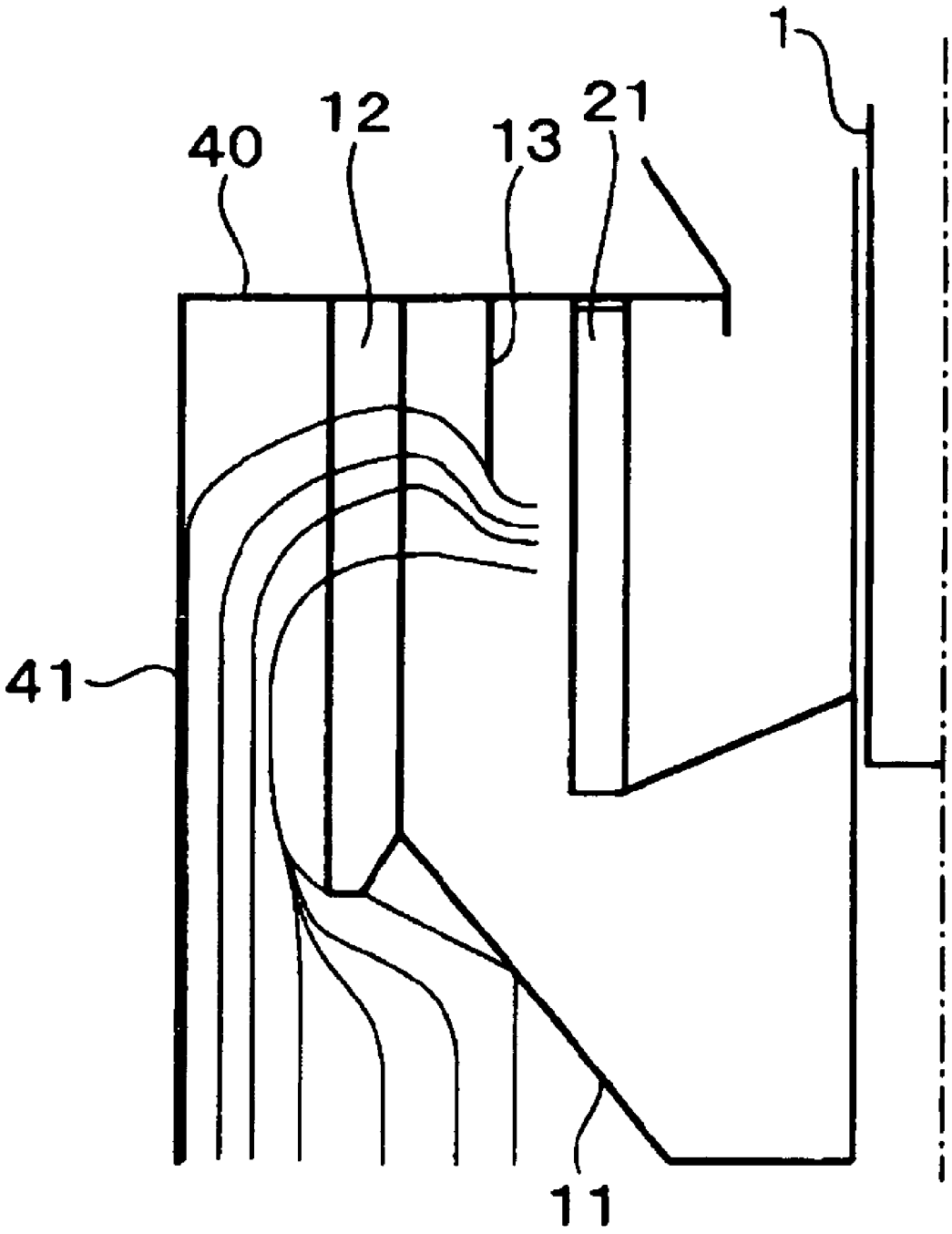
FIG. 26 is a view showing a locus of the group of particles within the classifier.
Figure 27A:
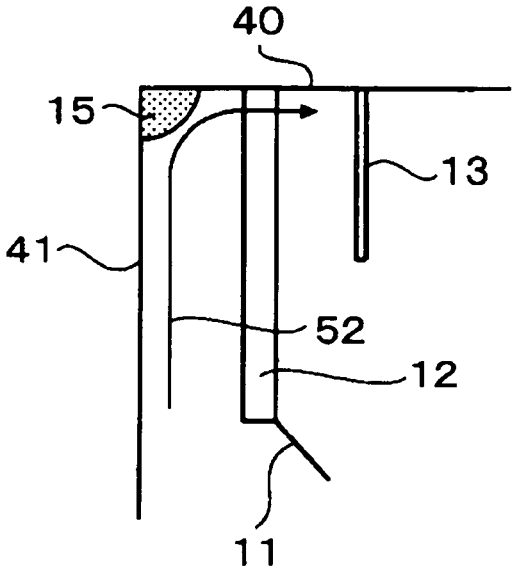
FIG. 27A is a view for explaining a mechanism from a generation of the circulating swirl flow to the development thereof within the classifier.
Figure 27B:
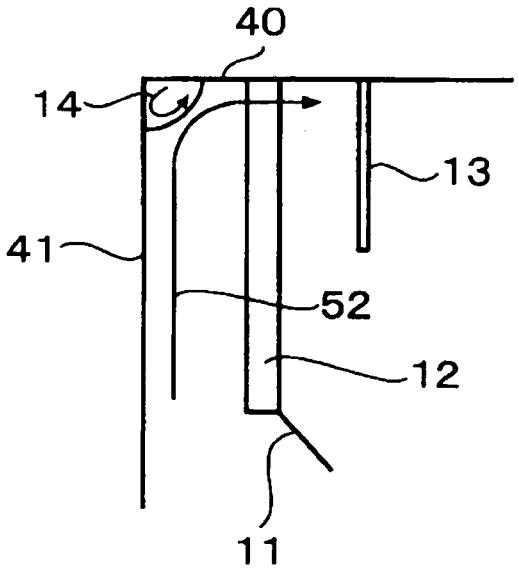
FIG. 27B is a view for explaining the mechanism from the generation of the circulating swirl flow to the development thereof within the classifier.
Figure 27C:
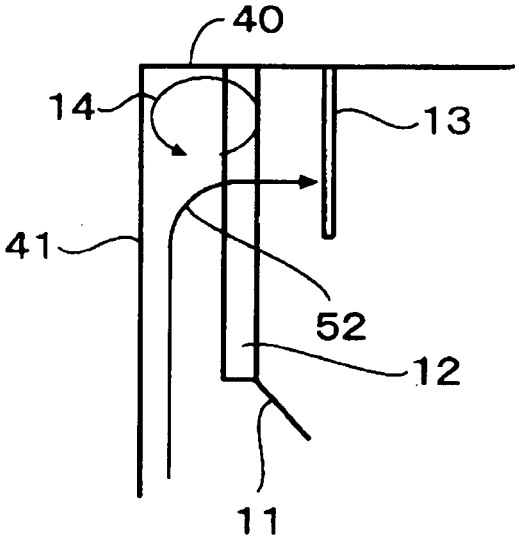
FIG. 27C is a view for explaining the mechanism from the generation of the circulating swirl flow to the development thereof within the classifier.
Figure 28:
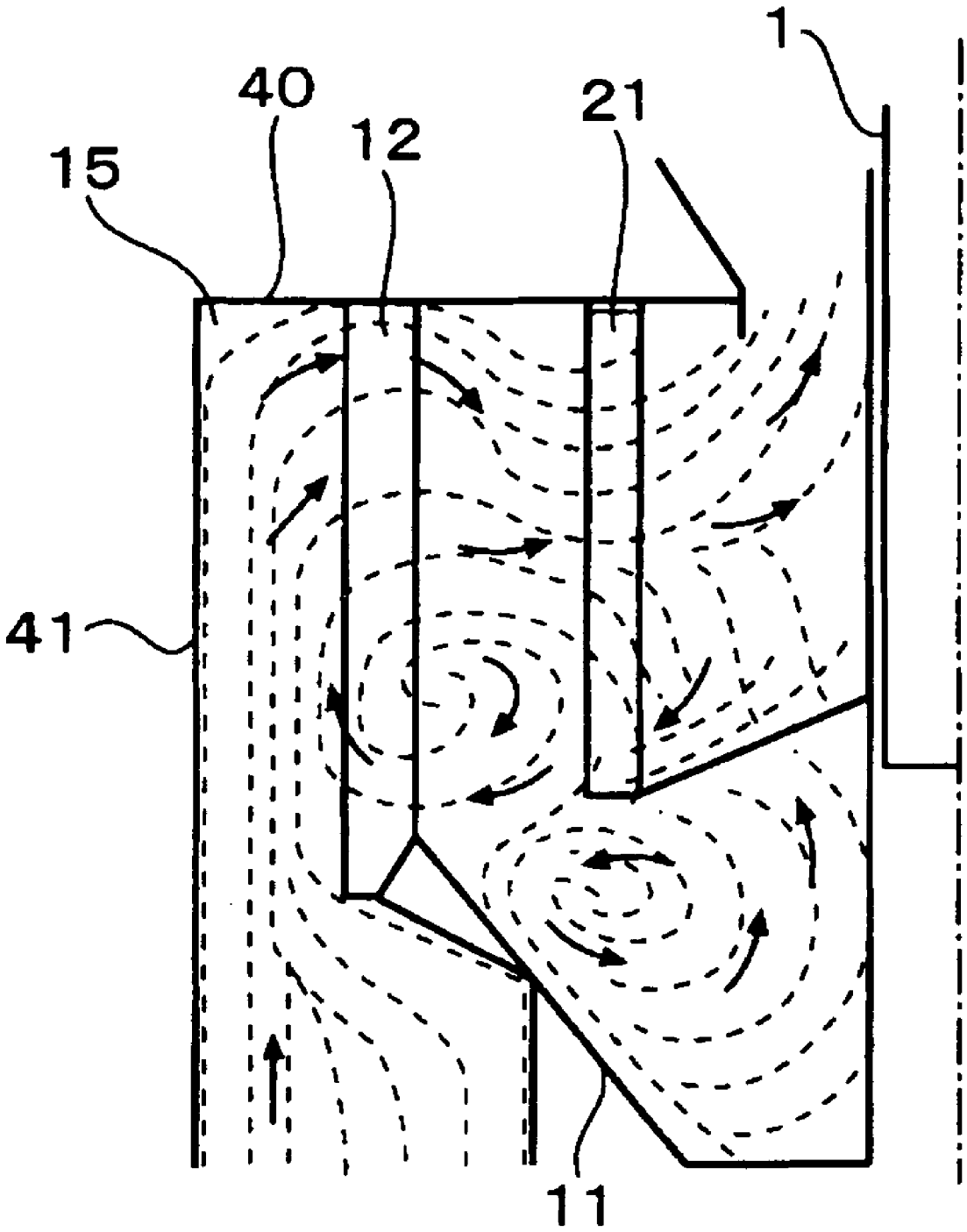
FIG. 28 is a view showing a gas flow pattern in accordance with a flow numerical analysis within the conventional classifier provided with no downward flow forming member.

1 coal feeding tube
2 crushing table
3 crushing ball
4 throat
5 crushing portion
6 classifier
7 discharge pipe
10 fixed type classifying mechanism
11 recovery cone
12 fixed fin
13 downward flow forming member
14 circulating swirl flow
15 stagnation portion
16 contraction flow region
17 short pass preventing member
20 rotary type classifying mechanism
21 rotating fin
22 rotating shaft
24 motor
30 circulating swirl flow development suppressing portion
31 circular arc-shaped plate
32 support plate
40 upper surface plate
41 housing

50 coal
51 hot wind
52 solid and gas two-phase flow
53 coarse particle
54 fine particle
61 positive blower
62 primary air positive blower
63 vertical crusher
64 air preheater
65 coal bunker
66 coal feeder
67 coal fired boiler apparatus
68 wind box
69 air preheater
70 dust collector
71 denitration device
72 induced draft fan
73 desulfurization device
74 chimney

The invention claimed is:

1. A classifier comprising:

a rotating fin executing a classification of solid particles on the basis of a centrifugal force;

a tubular downward flow forming member provided in an outer peripheral side of the rotating fin; and a bowl-shaped recovery cone arranged in a lower side of said rotating fin and the downward flow forming member;

a housing accommodating said rotating fin, the downward flow forming member and the recovery cone, in which a contraction flow region is formed between the housing and the recovery cone, a two-phase flow is constituted by mixture of said solid particles blown up through the contraction flow region from the lower side of the recovery cone and a gas, the particles in said two-phase flow are separated into fine particles and coarse particles by bringing the two-phase flow into collision with said downward flow forming member in an upper portion of said housing so as to form a downward flow, and thereafter conducting the downward flow to said rotating fin side, and the fine particles are taken out while passing through the portion between the rotating fins rotating together with the air flow, wherein a circulating swirl flow development suppressing portion for suppressing a development of a circular swirl flow generated at its position is provided in an upper side of said contraction flow region and at an outer peripheral position of said downward flow forming member in such a manner as to have a lower end portion in a side wall upper portion of said housing and have an upper end portion in an outer peripheral portion of the upper surface plate, and in the case that a distance from a side wall of said housing to said downward flow forming member is set to L, a horizontal width from the side wall of the housing to an upper end portion of said circulating swirl flow development suppressing portion is set to W, and a vertical height from said upper surface plate to a lower end portion of said circulating swirl flow development suppressing portion is set to H3, a ratio W/L is regulated to be equal to or more than 0.15: and a ratio H3/L is regulated in a range between 0.15 and 1.

2. A classifier as claimed in claim 1, wherein an angle of gradient of said circulating swirl flow development suppressing portion is regulated in a range between 15 and 75 degree.

3. A classifier as claimed in claim 1, wherein said circulating swirl flow development suppressing portion is formed by bending an upper portion of a side wall of said housing or an outer peripheral portion of an upper surface plate.

4. A classifier as claimed in claim 1, wherein said circulating swirl flow development suppressing portion is formed in a circular arc shape in such a manner that an inner side is concaved from an upper portion of a side wall of the housing to an outer peripheral portion of the upper surface plate.

5. A classifier as claimed in claim 4, wherein in the case that a distance from a side wall of said housing to said downward flow forming member is set to L, and a radius of curvature of said circulating swirl flow development suppressing portion is set to R, a ratio R/L is regulated in a range between 0.25 and 1.

6. classifier as claimed in claim 1, wherein in the case that a height in a direction of a rotating axis of said rotating fin is set to H1, and a height in a direction of a rotating axis of said downward flow forming member is set to H2, a ratio H2/H1 is regulated in a range between ½and ¼.

7. A classifier as claimed in claim 1, wherein a lot of fixed fins are provided between said downward flow forming member and the circulating swirl flow development suppressing portion so as to be fixed at an optional angle with respect to a direction of a rotating axis of said rotating fin.

8. A classifier as claimed in claim 1, wherein a short pass preventing member is provided in an upper portion of said recovery cone.

9. A classifier comprising:

a rotating fin executing a classification of solid particles on the basis of a centrifugal force;

a tubular downward flow forming member provided in an outer peripheral side of the rotating fin; and a bowl-shaped recovery cone arranged in a lower side of said rotating fin and the downward flow forming member;

a housing accommodating said rotating fin, the downward flow forming member and the recovery cone, in which a contraction flow region is formed between the housing and the recovery cone, a two-phase flow is constituted by mixture of said solid particles blown up through the contraction flow region from the lower side of the recovery cone and a gas, the particles in said two-phase flow are separated into fine particles and coarse particles by bringing the two-phase flow into collision with said downward flow forming member in an upper portion of said housing so as to form a downward flow, and thereafter conducting the downward flow to said rotating fin side, and the fine particles are taken out while passing through the portion between the rotating fins rotating together with the air flow, wherein a circulating swirl flow development suppressing portion for suppressing a development of a circular swirl flow generated at its position is provided in an upper side of said contraction flow region and at an outer peripheral position of said downward flow forming member in such a manner as to have a lower end portion in a side wall upper portion of said housing and have an upper end portion in an outer peripheral portion of the upper surface plate, and in the case that a distance from a side wall of said housing to said downward flow forming member is set to L, and a horizontal width from the side wall of the housing to an upper end portion of said circulating swirl flow development suppressing portion is set to W, a ratio W/L is regulated to be equal to or more than 0.15; and wherein said circulating swirl flow development suppressing portion is formed by a slant member bridged over an outer peripheral portion of an upper surface plate provided in an upper surface of the housing from an upper portion of a side wall of said housing.

10. A vertical crusher comprising:

a crushing portion crushing a raw material on the basis of an engagement between a crushing table and a crushing ball or a crushing roller; and a classifier installed in an upper portion of the crushing portion and classifying in a predetermined grain size, wherein said classifier is constituted by the classifier as claimed in claim 1.

11. A coal fired boiler apparatus comprising:

a vertical crusher provided with a crushing portion crushing a raw material on the basis of an engagement between a crushing table and a crushing ball or a crushing roller, and a classifier installed in an upper portion of the crushing portion and classifying in a predetermined grain size; and the coal fired boiler apparatus burning a pulverized coal having a predetermined grain size and obtained by the vertical crusher, wherein said classifier is constituted by the classifier as claimed in claim 1.

* * * * *